US012669251B2

(12) United States Patent
Tanaka et al.

(10) Patent No.: US 12,669,251 B2
(45) Date of Patent: Jun. 30, 2026

(54) HEAT EXCHANGER, HEAT EXCHANGE UNIT, AND AIR CONDITIONER

(71) Applicant: Mitsubishi Electric Corporation, Tokyo (JP)

(72) Inventors: Yuri Tanaka, Tokyo (JP); Koki Moro, Tokyo (JP); Keisuke Tomomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 151 days.

(21) Appl. No.: 18/842,937

(22) PCT Filed: Aug. 2, 2022

(86) PCT No.: PCT/JP2022/029572
§ 371 (c)(1),
(2) Date: Aug. 30, 2024

(87) PCT Pub. No.: WO2024/028964
PCT Pub. Date: Feb. 8, 2024

(65) Prior Publication Data

US 2025/0172300 A1 May 29, 2025

(51) Int. Cl.
*F24F 1/00* (2019.01)
*F24F 1/0063* (2019.01)
(Continued)

(52) U.S. Cl.
CPC ..... *F24F 1/0063* (2019.02); *F24F 1/0067* (2019.02); *F28F 9/007* (2013.01)

(58) Field of Classification Search
CPC .... F28F 9/013; F28F 2220/00; F28F 2280/06; F28F 9/007; F24F 13/30; F24F 13/22;
(Continued)

(56) References Cited

U.S. PATENT DOCUMENTS 1,805,116 A * 5/1931 Trane ..... F28D 1/0475 165/181
2,022,173 A * 11/1935 Alexander ..... F28F 1/422 165/145

(Continued)

FOREIGN PATENT DOCUMENTS

CN 108507373 A * 9/2018 ..... F28D 1/0475
JP 2021-055953 A 4/2021
WO 2020/165970 A1 8/2020

OTHER PUBLICATIONS

International Search Report of the International Searching Authority mailed Sep. 6, 2022 in corresponding International Patent Application No. PCT/JP2022/029572 (and English translation).

*Primary Examiner* — Tho V Duong
(74) *Attorney, Agent, or Firm* — Posz Law Group, PLC

(57) ABSTRACT

A heat exchanger includes a heat exchanger main body that extends in a first direction, and has a heat transfer pipe a having a plurality of fins attached thereto, and a holder attached to an end thereof. The heat transfer pipe has extension portions, and fold portions that connect to adjacent ends thereof. The holder has a base on one side of the heat exchanger main body, and a peripheral wall that protrudes to the first direction, and a partition wall that partitions an inside thereof in a second direction. Formed accommodations align in the second direction, and a through hole through which a fold portion is inserted, formed on each base on the accommodations. An inside edge of the through hole is disposed apart from the fold portion. The partition wall includes a first partition wall, and a through portion which penetrates the first partition wall, and is formed thereon.

10 Claims, 13 Drawing Sheets

(51) Int. Cl.
*F24F 1/0067* (2019.01)
*F28F 9/007* (2006.01)

(58) Field of Classification Search
CPC ..... F24F 1/0067; F24F 1/0063; F28D 7/1623; F28D 1/0475; F28D 1/047
See application file for complete search history.

(56) References Cited

U.S. PATENT DOCUMENTS 3,253,651 A * 5/1966 Larson ..... F28F 9/26 165/122
6,109,044 A * 8/2000 Porter ..... F28D 15/0266 62/96
2022/0316717 A1* 10/2022 Sakarwala ..... F24F 5/0017

* cited by examiner

HEAT EXCHANGER, HEAT EXCHANGE UNIT, AND AIR CONDITIONER

CROSS REFERENCE TO RELATED APPLICATION

This application is a U.S. national stage application of PCT/JP2022/029572 filed on Aug. 2, 2022, the contents of which are incorporated herein by reference.

TECHNICAL FIELD

The present disclosure pertains to a heat exchanger, a heat exchange unit, and an air conditioner.

BACKGROUND ART

For example, as shown in Patent Document 1, an air conditioner having a holder that has an opening (through hole) which receives a hair pin portion (fold) that connects two ends of straight pipes which are joined to an end of a heat exchanger (heat exchanger main body) is known. In an air conditioner of Patent Document 1, a gap between an inner periphery of an opening and a hair pin portion, through which condensate (condensation) due to gravity flows, is provided.

CITATION LIST

Patent Document

Patent Document 1: Japanese Unexamined Patent Application, First Publication No. 2021-55953

SUMMARY OF INVENTION

Problem to be Solved by the Invention

In the aforementioned holder, for example, by having partition walls provided for reinforcement or the like, a plurality of accommodations that accommodate hair pin portions are formed. As such, there is a risk of condensate (condensation) that does not flow between an inner periphery of an opening, and a hair pin portion out of the hair pin portions, from accumulating on an inside of the accommodation.

The present disclosure has been made in order to address the problem above, and an object is to provide a heat exchanger having a structure that suppresses condensation from accumulating on an inside of an accommodation of a holder, to provide a heat exchange unit that includes such heat exchanger, and to provide an air conditioner that includes such a heat exchange unit.

Means to Solve the Problem

A heat exchanger according to an embodiment of the present disclosure, is a heat exchanger that is included in an air conditioner, and includes a heat exchanger main body that extends in a first direction which intersects a vertical direction, and that has a heat transfer pipe and a plurality of fins which are attached to the heat transfer pipe, and a holder that is attached to one end of the first direction on the heat exchanger main body. The heat transfer pipe has a plurality of extension portions that extend in the first direction, and a plurality of fold portions that connect ends of pairs of the extension portions adjacent to one another in the first direction. The holder has a base located on one side of the first direction of the heat exchanger main body, a peripheral wall that protrudes to one side of the first direction, from an outside peripheral edge of the base, and at least one partition wall that partitions an inside of the peripheral wall in a second direction, that intersects a horizontal direction. A plurality of accommodations are formed so as to align in the second direction, using the base, the peripheral wall, and at least one partition wall. A through hole through which a fold portion out of the plurality of fold portions is inserted, is formed on each base on the plurality of accommodations. An inside edge of the through hole is disposed apart from the fold portion. Said at least one partition wall includes a first partition wall, and at least one through portion which penetrates the first partition wall is formed on the first partition wall.

An embodiment of a heat exchange unit according to the present disclosure may further include the aforementioned heat exchanger, and a blower that blows air to the heat exchanger.

An embodiment of an air conditioner according to the present disclosure may include an indoor unit, and an outdoor unit. At least one of the indoor unit or the outdoor unit is the aforementioned heat exchange unit.

Effects of the Invention

According to the present disclosure, it is possible to suppress condensation from accumulating on an inside of an accommodation of a holder, in a heat exchanger of an air conditioner.

DESCRIPTION OF EMBODIMENTS

Figure 1:
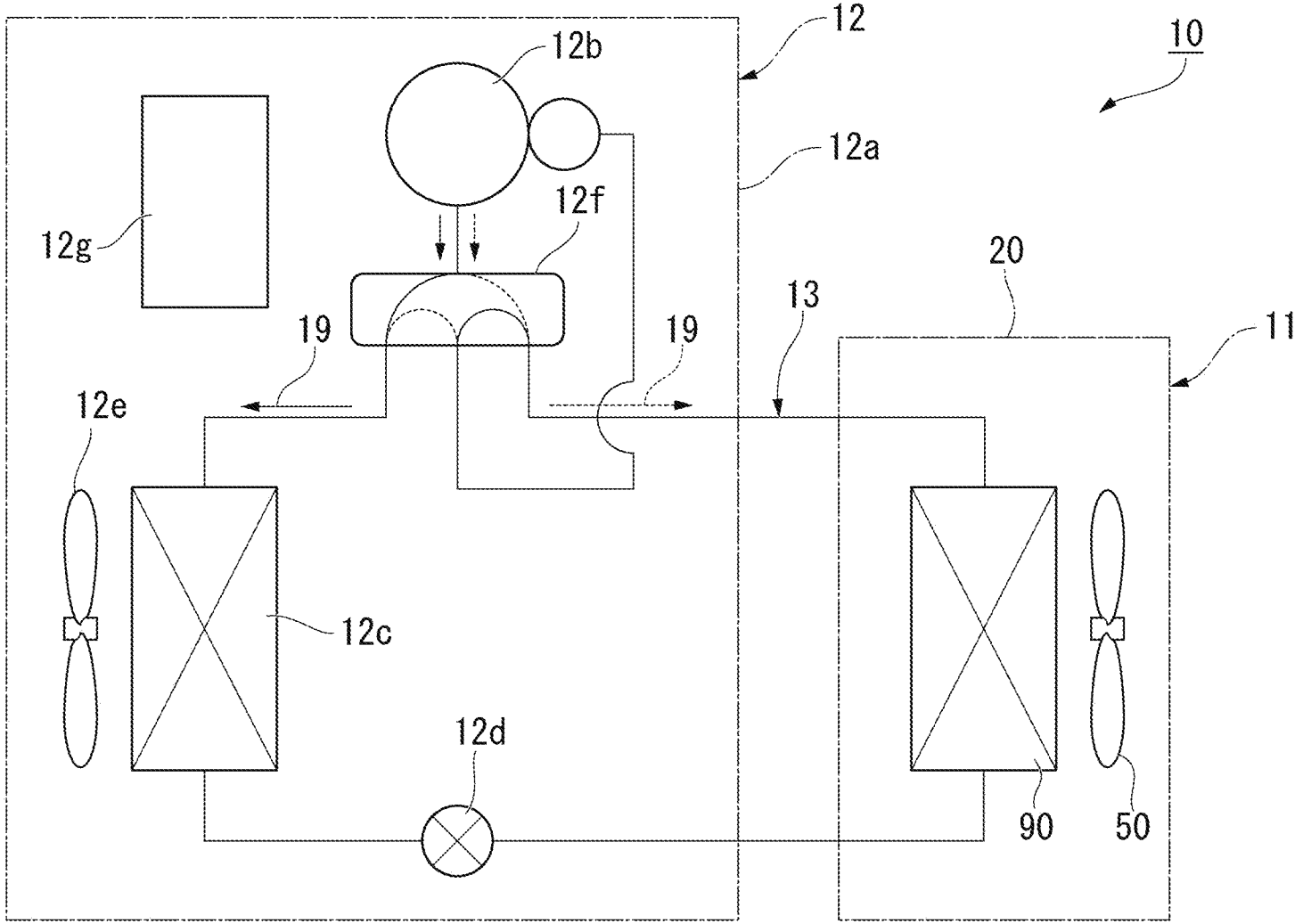
FIG. 1 A schematic view that shows an outline configuration of an air conditioner in in an embodiment.

Hereinafter, embodiments of the present disclosure are explained with reference to the drawings. The scope of the present disclosure is not limited to the embodiments below, and may be changed so long as the embodiments do not depart from the technical scope of the present disclosure. In the drawings below, scales and dimensions of various configurations may differ from scales and dimensions in the drawings below to facilitate better understanding of the various embodiments.

The drawings show an X axis, a Y axis, and a Z axis where appropriate. The X axis shows a side out of sides of a horizontal direction. The Y axis shows another side out of sides of the horizontal direction. The Z axis shows a vertical direction. In the explanation below, a horizontal direction along the X axis is referred to as a "front-rear direction X", and a horizontal direction along the Y axis is referred to as a "left-right direction Y" (first direction). A vertical direction along the Z axis is referred to as a "vertical direction Z". The front-rear direction X, the left-right direction Y, and the vertical direction Z are mutually orthogonal directions. In the explanation below, a side out of sides of the vertical direction Z in which the arrow of the Z axis faces is a "top side" (+Z side). The other side out of sides of the vertical direction Z which faces an opposite side the arrow of the Z axis faces is a "bottom side" (−Z side). A side out of sides in the front-rear direction X in which the arrow of the X axis faces is a "front side" (+X side). The other side out of sides of the front-rear direction X which faces an opposite side the arrow of the X axis faces is a "rear side" (−X side). The left-right direction Y is a left-right direction in a case where an indoor unit 11 in the embodiments below is seen from the front (+X direction). In other words, a side out of sides of the left-right direction Y in which the arrow of the Y axis faces is a "right side" (+Y axis). Another side out of sides of the left-right direction Y which faces an opposite side the arrow of the Y axis faces is a "left side" (−Y side).

In the embodiments below, the left-right direction Y corresponds to a "first direction". In the embodiments below, the left side (−Y side) corresponds to "one side of the first direction", and the right side (+Y side) corresponds to "another side of the first direction".

Figure 2:
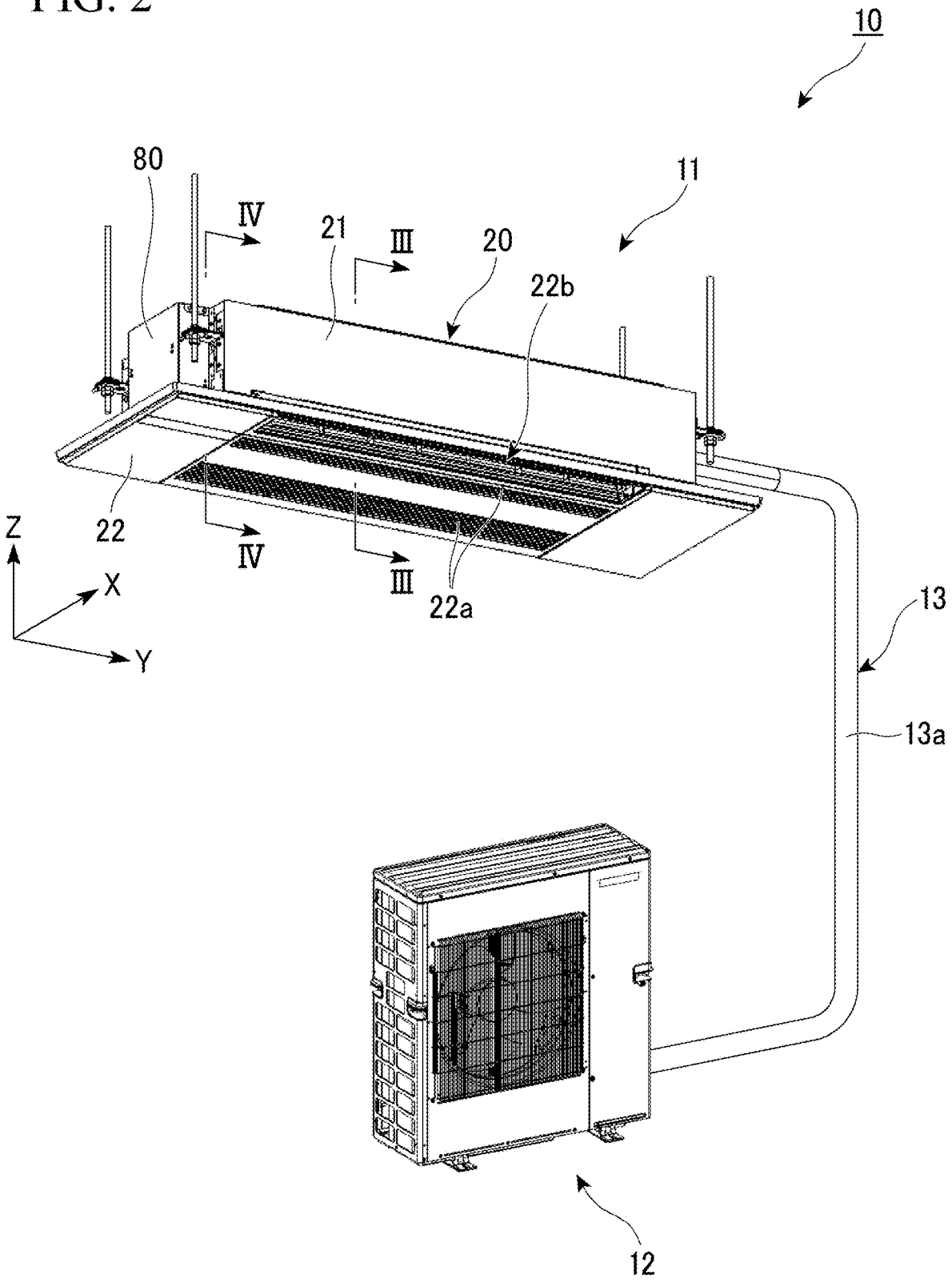
FIG. 2 A perspective view that shows the air conditioner in the embodiment.

FIG. 1 is a schematic view that shows an outline configuration of an air conditioner 10 in in the embodiment. FIG. 2 is a perspective view that shows the air conditioner 10 in the embodiment. As shown in FIG. 1 and in FIG. 2, the air conditioner 10 includes an indoor unit (heat exchange unit) 11, an outdoor unit 12, and a circulation path 13. The indoor unit 11 is disposed indoors. The outdoor unit 12 is disposed outdoors. The indoor unit 11 and the outdoor unit 12 are connected to one another by the circulation path 13 that circulates a refrigerant 19. More specifically, as shown in FIG. 2, the indoor unit 11 and the outdoor unit 12 are connected by a pipe bundle 13*a* that configures a portion of the circulation path 13. The indoor unit 11 and the outdoor unit 12 are heat exchange units that conduct heat exchange with air.

By having the refrigerant 19 that flows within the circulation path 13, and the indoor unit 11 conduct heat exchange with air indoors, it is possible for the air conditioner 10 to adjust a temperature of the air indoors. A refrigerant such as a fluorine based refrigerant with a low global warming potential (GWP: Global Warming Potential), or a hydrocarbon based refrigerant or the like may be mentioned as examples of the refrigerant 19.

As shown in FIG. 1, the outdoor unit 12 includes a housing 12*a*, a compressor 12*b*, a heat exchanger 12*c*, a flow adjustment valve 12*d*, a blower 12*e*, a four-way valve 12*f*, and a control circuit 12*g*. The compressor 12*b*, the heat exchanger 12*c*, the flow adjustment valve 12*d*, the blower 12*e*, the four-way valve 12*f*, and the control circuit 12*g* are housed on an inside of the housing 12*a*.

The compressor 12*b*, the heat exchanger 12*c*, the flow adjustment valve 12*d*, and the four-way valve 12*f* are provided on a part that is located on the inside of the housing 12*a*, out of the circulation path 13. The compressor 12*b*, the heat exchanger 12*c*, the flow adjustment valve 12*d*, and the four-way valve 12*f* are connected by the part that is located on the inside of the housing 12*a*, out of the circulation path 13.

The four-way valve 12*f* is provided on a part that is connected to a discharge side of the compressor 12*b*, out of the circulation path 13. By exchanging a portion of the circulation path 13, it is possible for the four-way valve 12*f* to reverse a direction of flow of the refrigerant 19 within the circulation path 13. When the path connected by the four-way valve 12*f* is the path of the four-way valve 12*f* that is shown by solid lines in FIG. 1, the refrigerant 19 within the circulation path 13 flows in the direction shown by the solid line arrow in FIG. 1. On the other hand, when the path connected by the four-way valve 12*f* is the path of the four-way valve 12*f* that is shown by dashed lines in FIG. 1, the refrigerant 19 flows within the circulation path 13 in the direction shown by the dashed line arrow in FIG. 1.

The indoor unit 11 includes a housing 20, a heat exchanger 90, and a blower 50 that blows air to a heat exchanger 90. The housing 20 houses the heat exchanger 90, and the blower 50 on an inside thereof. It is possible for the indoor unit 11 to have a cooling operation where the air inside the room the indoor unit 11 is disposed in is cooled, and to have a heating operation where the air inside the room the indoor unit 11 is disposed in is heated.

When the indoor unit 11 is operated in the cooling operation, the refrigerant 19 that flows within the circulation path 13, flows in the direction shown by solid lines in FIG. 1. In other words, when the indoor unit 11 is operated in the cooling operation, the refrigerant 19 that flows within the circulation path 13 circulates so as to return to the compressor 12*b* after passing through the compressor 12*b*, the heat exchanger 12*c* of the outdoor unit 12, the flow adjustment valve 12*d*, and the heat exchanger 90 of the indoor unit 11 in such an order. During the cooling operation, the heat exchanger 12*c* on an inside of the outdoor unit 12 functions as a condenser, and the heat exchanger 90 on an inside of the indoor unit 11 functions as an evaporator.

On the other hand, when the indoor unit 11 is operated in the heating operation, the refrigerant 19 that flows within the circulation path 13 flows in the direction shown by dashed lines in FIG. 1. In other words, when the indoor unit 11 is operated in the heating operation, the refrigerant 19 that flows within the circulation path 13 circulates so as to return to the compressor 12*b* after passing through the compressor 12*b*, the heat exchanger 90 of the indoor unit 11, the flow adjustment valve 12*d*, and the heat exchanger 12*c* of the outdoor unit 12 in such an order. During the heating operation, the heat exchanger 12*c* on the inside of the outdoor unit 12 functions as the evaporator, and the heat exchanger 90 on the inside of the indoor unit 11 functions as the condenser.

Figure 3:
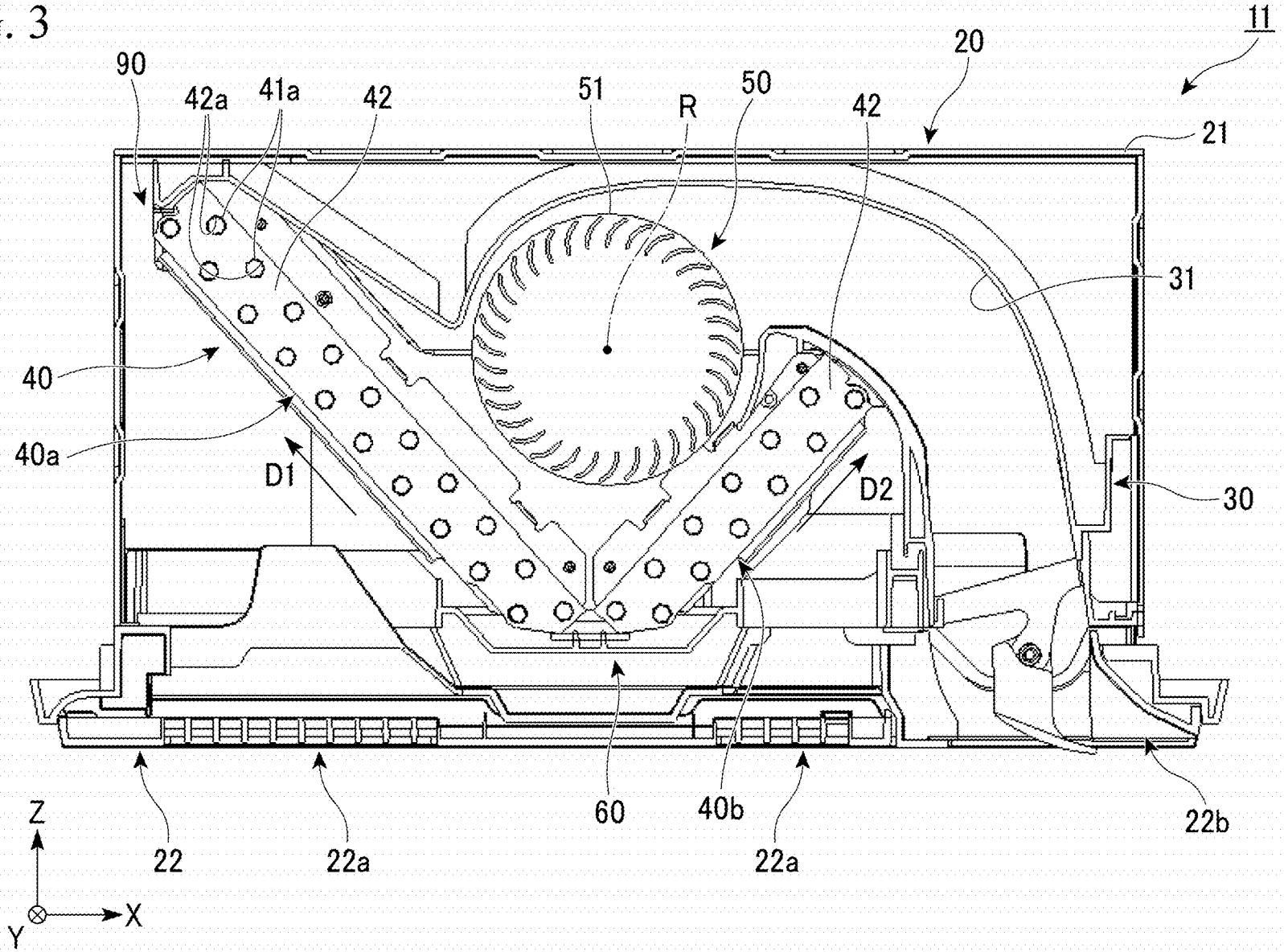
FIG. 3 A cross-sectional view that shows an indoor unit in the embodiment, and is a cross-sectional view taken from III-III in FIG. 2.
Figure 4:
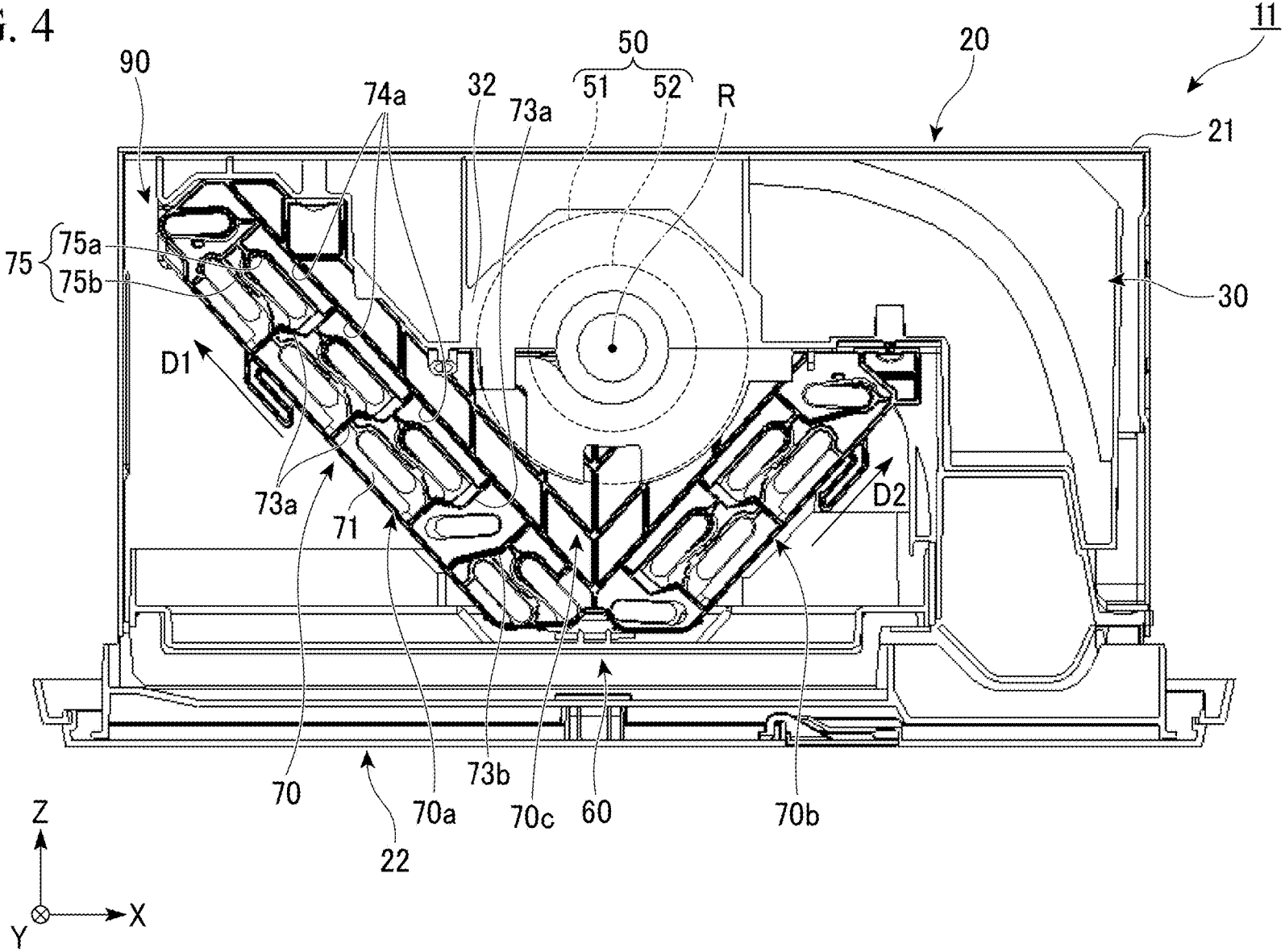
FIG. 4 A cross-sectional view that shows the indoor unit in the embodiment, and is a cross-sectional view taken from IV-IV in FIG. 2.

Next, the indoor unit 11 is explained in further detail. FIG. 3 is a cross-sectional view that shows the indoor unit 11 in the embodiment, and is a cross-sectional view taken from III-III in FIG. 2. FIG. 4 is a cross-sectional view that shows the indoor unit 11 in the embodiment, and is a cross-sectional view taken from IV-IV in FIG. 2. As shown from FIG. 2 to FIG. 4, the indoor unit 11 is a ceiling type indoor unit that is setup and embedded into a ceiling. The housing 20 of the indoor unit 11 has a housing main body 21, and a decorative panel 22.

The housing main body 21 extends in the left-right direction Y, and is a semi-square shaped box that opens to the bottom side. The housing main body 21 is setup and embedded in the ceiling indoors where the indoor unit 11 is setup. As shown in FIG. 2, the housing main body 21 is fixed to the ceiling via four hanging bolts that extend in the vertical direction Z. A top end of each hanging bolt is fixed to a ceiling slab.

The decorative panel 22 is attached to an opening on the bottom side of the housing main body 21. The decorative panel 22 is exposed to the indoors where the indoor unit 11 is setup. The decorative panel 22 is a long semi-rectangular plate shape that extends in the left-right direction Y. The decorative panel 22 protrudes to both sides of the left-right direction Y, more than the housing main body 21. An intake port 22*a* and an exhaust port 22*b* are formed on the decorative panel 22. Two intake ports 22*a* are provided in the front-rear direction X, with an interval therebetween. Each of the intake ports 22*a* is partitioned into a lattice pattern. The exhaust port 22*b* is located on the front side (+X side), more than the intake ports 22*a*.

As shown in FIG. 3, an air flow path member 30 is disposed on an inside of the housing main body 21. The air flow path member 30 has an air flow path 31 that extends from the blower 50 to the exhaust port 22*b*. The air flow path 31 curves to the bottom side after extending to the front side (+X side) from the blower 50, and extends to the exhaust port 22*b*. As shown in FIG. 4, the air flow path member 30 has a side wall 32 that covers the blower 50 from the left side (−Y side). The side wall 32 is located on the top side of a holder 70 to be mentioned later on, out of the heat exchanger 90.

As shown in FIG. 2, an electric components box 80 is attached on a side surface on the left side (−Y side) of the housing main body 21. The electric components box 80 is located on the top side of a part that protrudes to the left side, more than the housing main body 21 out of the decorative panel 22. A control board that controls the indoor unit 11 is housed on an inside of the electric components box 80.

The blower 50 in the present embodiment is a cross-flow fan that extends in the left-right direction Y. As shown in FIG. 4, the blower 50 has an impeller 51 that extends in the left-right direction Y, and a drive portion 52 that causes the impeller 51 to rotate about a rotation axis R which extends in the left-right direction Y. The drive portion 52 is a motor. The drive portion 52 is held by the side wall 32 of the air flow path member 30. The drive portion 52 is electrically connected to the control board on the inside of the electric components box 80. Indoor air is taken in to an inside of the housing 20 from the intake port 22*a* by having the drive portion 52 cause the impeller 51 to rotate based on a signal received from said control board. Air that is taken to the inside of the housing 20 passes through the heat exchanger 90, is taken in by the impeller 51, and is discharged to the air flow path 31 from the impeller 51. Air that is discharged from the air flow path 31 flows from the flow path 31, and is exhausted to the indoors from the exhaust port 22*b*.

Figure 5:
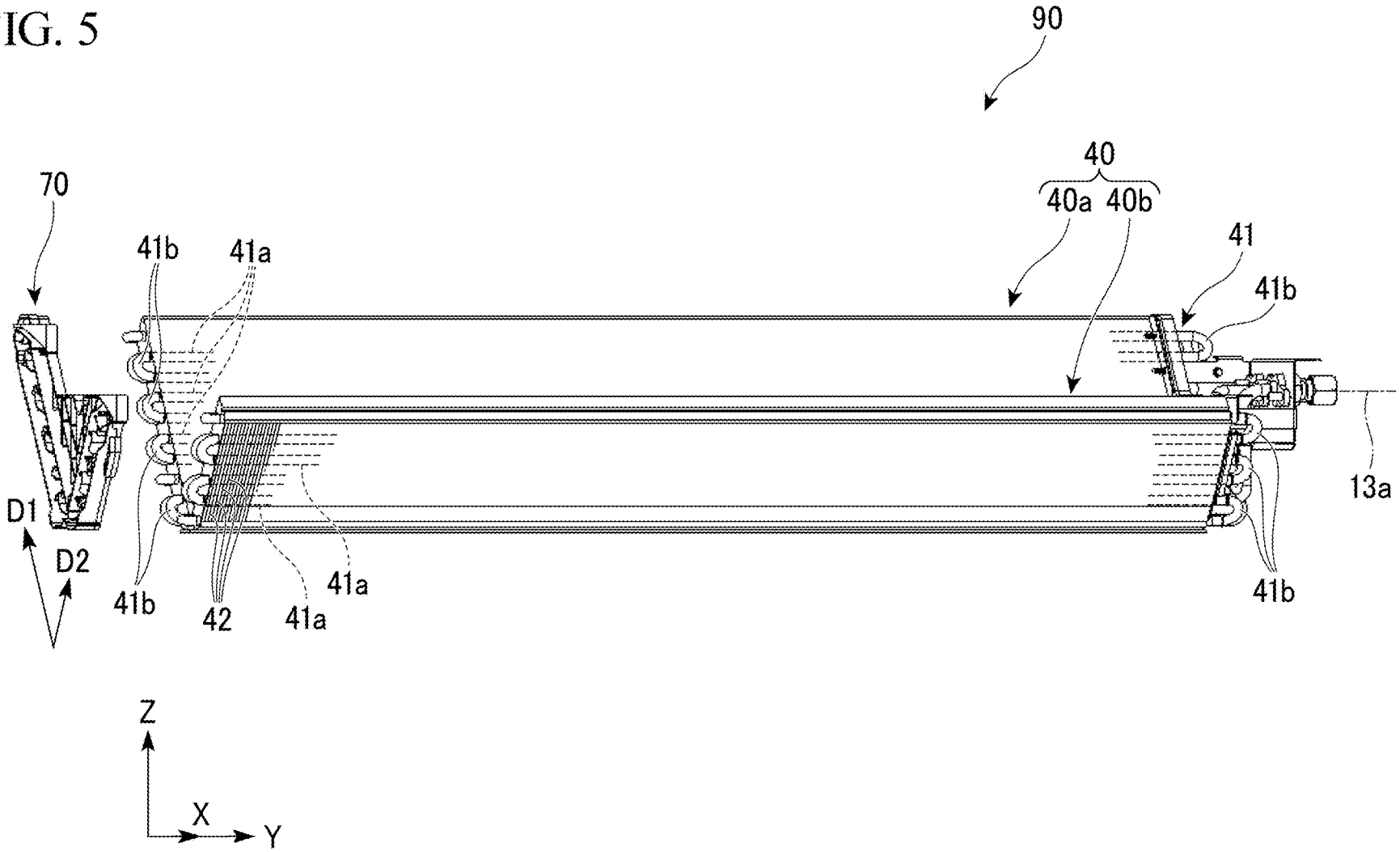
FIG. 5 An exploded perspective view that shows a heat exchanger in the embodiment.

FIG. 5 is an exploded perspective view that shows the heat exchanger 90. As shown in FIG. 5, the heat exchanger 90 extends in the left-right direction Y. The heat exchanger 90 includes a heat exchanger main body 40 which extends in the left-right direction Y that extends with the vertical direction Z, and the holder 70 attached to an end of the left side (−Y side) on the heat exchanger main body 40.

The heat exchanger main body 40 in the present embodiment has a first heat exchanger portion 40*a*, and a second heat exchanger portion 40*b*. The first heat exchanger portion 40*a* is located on the rear side (−X side) of the second heat exchanger portion 40*b*. As shown in FIG. 3, the first heat exchanger portion 40*a* and the second heat exchanger portion 40*b* extend in a direction where the first heat exchanger portion 40*a* and the second heat exchanger portion 40*b* move apart from one another in the front-rear direction X as the top side is approached, as seen from the left-right direction Y. A Bottom end of the first heat exchanger portion 40*a* and a bottom end of the second heat exchanger portion 40*b* are connected to one another on a bottom side of the blower 50. The heat exchanger main body 40 forms a semi-V shape due to the first heat exchanger portion 40*a* and the second heat exchanger portion 40*b*, as seen in the left-right direction Y.

In the explanations below, a direction in which the first heat exchanger portion 40*a* extends in, as seen in the left-right direction Y, is referred to as a "first diagonal direction (second direction) D1". A direction in which the second heat exchanger portion 40*b* extends in, as seen in the left-right direction Y, is referred to as a "second diagonal direction (second direction) D2". The first diagonal direction D1 and the second diagonal direction D2 correspond to the second direction, which intersects with the horizontal direction. The first diagonal direction D1 and the second diagonal direction D2 are orthogonal with the left-right direction Y, and diagonally incline with respect to both the front-rear direction X and the vertical direction Z. The first diagonal direction D1 is a direction that moves towards the rear side (−X side) as the top side is approached. The second diagonal direction D2 is a direction that moves towards the front side (+X side) as the top side is approached.

In the explanation below, a side out of the first diagonal direction D1 in which the arrow D1 faces (+D1 side) in the appropriate drawings, in other words the top side (+Z side) and the rear side (−X side) in the first diagonal direction D1, is referred to as a "side of the first diagonal direction D1". Another side out of the first diagonal direction D1 which is an opposite side (−D1 side) to the side the arrow D1 faces in the appropriate drawings, in other words the bottom side (−Z side) and the front side (+X side) in the first diagonal direction D1, is referred to as an "other side of the first diagonal direction D1".

A top side portion of the first heat exchanger portion 40*a* and a top side portion of the second heat exchanger portion 40*b* are disposed so as to sandwich the blower 50 in the front-rear direction X. A top end of the first heat exchanger portion 40*a* is located on the top side, more than a top end of the second heat exchanger portion 40*b*. The top end of the first heat exchanger portion 40*a* is located on the top side, more than a top end of the blower 50. The top end of the second heat exchanger portion 40*b* is located on the bottom side, more than the top end of the blower 50.

The first heat exchanger portion 40*a* is located apart on a top side of the intake port 22*a* located on the rear side (−X side) out of the two intake ports 22*a*. Air taken to the inside of the housing 20 from the intake port 22*a* located on said rear side passes through the first heat exchanger portion 40*a*, and is taken in by the impeller 51 of the blower 50. The second heat exchanger portion 40*b* is located apart on the on the top side of the intake port 22*a* that is located on the front side (+X side) out of the two intake ports 22*a*. Air taken to the inside of the housing 20 from the intake port 22*a* located on said front side passes through the second heat exchanger portion 40*b*, and is taken in by the impeller 51 of the blower 50.

As shown in FIG. 5, the heat exchanger main body 40 has a heat transfer pipe 41, and a plurality of fins 42 attached to the heat transfer pipe 41. The heat transfer pipe 41 forms a portion of the circulation path 13. The refrigerant 19 flows on an inside of the heat transfer pipe 41. One end of the heat transfer pipe 41 and another end of the heat transfer pipe 41 are each connected to various pipes included in the circulation path 13. The refrigerant 19 that flows from the outdoor unit 12 to an inside of the one end of the heat transfer pipe 41 via pipes of the circulation path 13, flows to the outdoor unit 12 after flowing from the other end of the heat transfer pipe 41 to an inside of the other pipes of the pipe bundle 13*a*. There is a case where condensation forms on an outer surface of the heat transfer pipe 41, when the heat exchanger 90 functions as an evaporator or the like, and the refrigerant 19 has a low temperature, the heat transfer pipe 41 is cooled down by the refrigerant 19 that flows on the inside of the heat transfer pipe 41. For example, a plurality of heat transfer pipes 41 may be disposed.

The heat transfer pipe 41 in the present embodiment has a circular shaped cross-section. The heat transfer pipe 41 may for example, be made of a metal. As an example of a material that configures the heat transfer pipe 41, copper, or a copper alloy may be used. The material that configures the heat transfer pipe 41 may also be aluminum or an aluminum alloy. The heat transfer pipe 41 has a plurality of extension portions 41*a* that extend in the left-right direction Y, and a plurality of fold portions 41*b* that are connected to each end of adjacent extension portions 41*a* in the left-right direction Y. The heat transfer pipe 41 folds back alternately in the left-right direction Y and extends in a meandering shape, by having the plurality of extension portions 41*a* be connected to one another using the fold portions 41*b*. The plurality of extension portions 41*a* included in the first heat exchanger portion 40*a* are disposed so as to align in the first diagonal direction D1, with intervals therebetween. The plurality of extension portions 41*a* included in the second heat exchanger portion 40*b* are disposed so as to align in the second diagonal direction D2, with intervals therebetween.

The plurality of fold portions 41*b* include fold portions 41*b* that are located on the left side (−Y side), and fold portions 41*b* that are located on the right side (+Y side). Each of the fold portions 41*b* located on the left side extend in U shapes that open to the right side. Each of the fold portions 41*b* located on the right side extend in U shapes that open to the left side. Each fold portion 41*b* located on the left side protrudes to the left side, more than the plurality of fins 42. Each fold portion 41*b* located on the right side protrudes to the right side, more than the plurality of fins 42.

Each of the plurality of fold portions 41*b* that are located on ends on the left side (−Y side) of the first heat exchanger portion 40*a*, and the plurality of fold portions 41*b* that are located on ends on the right side (+Y side) of the first heat exchanger portion 40*a* are disposed so as to align in the first diagonal direction D1, with intervals therebetween. Each of the plurality of fold portions 41*b* that are located on ends on the left side of the second heat exchanger portion 40*b*, and the plurality of fold portions 41*b* that are located on ends on the right side of the second heat exchanger portion 40*b* are disposed so as to align in the second diagonal direction D2, with intervals therebetween.

The plurality of fins 42 are disposed so as to align via gaps in the left-right direction Y. Each of the plurality of fins 42 is a plate shape having a plate surface that faces the left-right direction Y. The plurality of the fins 42 are made of a metal. Aluminum or an aluminum alloy are examples of materials that configure the fins 42. As shown in FIG. 3, each of the plurality of fins 42 has a hole 42*a* through which an extension portion 41*a* is passed through, formed in plurality. Each of the plurality of fins 42 is fixed for example, to each of the plurality of extension portions 41*a* that is passed through each of the plurality of holes 42*a* by brazing.

The plurality of fins 42 include the plurality of fins 42 that form a portion of the first heat exchanger portion 40*a*, and the plurality of fins 42 that form a portion of the second heat exchanger portion 40*b*. The plurality of fins 42 that are include in the first heat exchanger portion 40*a* are semi-rectangular shapes that extend in the first diagonal direction D1. The plurality of fins 42 that are included in the second heat exchanger portion 40*b* are semi-rectangular shapes that extend in the second diagonal direction D2.

Air that passes through the heat exchanger 90, goes through the gaps between the fins 42. Although omitted from the drawings, portions of the extension portions 41*a* of the heat transfer pipes 41 are exposed in the gaps between the fins 42. Air that goes through the gaps between the fins 42 contacts the portions of the extension portions 41*a* that are exposed in said gaps, between the fins 42. As such, heat exchange is conducted between air that goes through the gaps between the fins 42, and the refrigerant 19 that flows on the inside of the heat transfer pipe 41.

Figure 6:
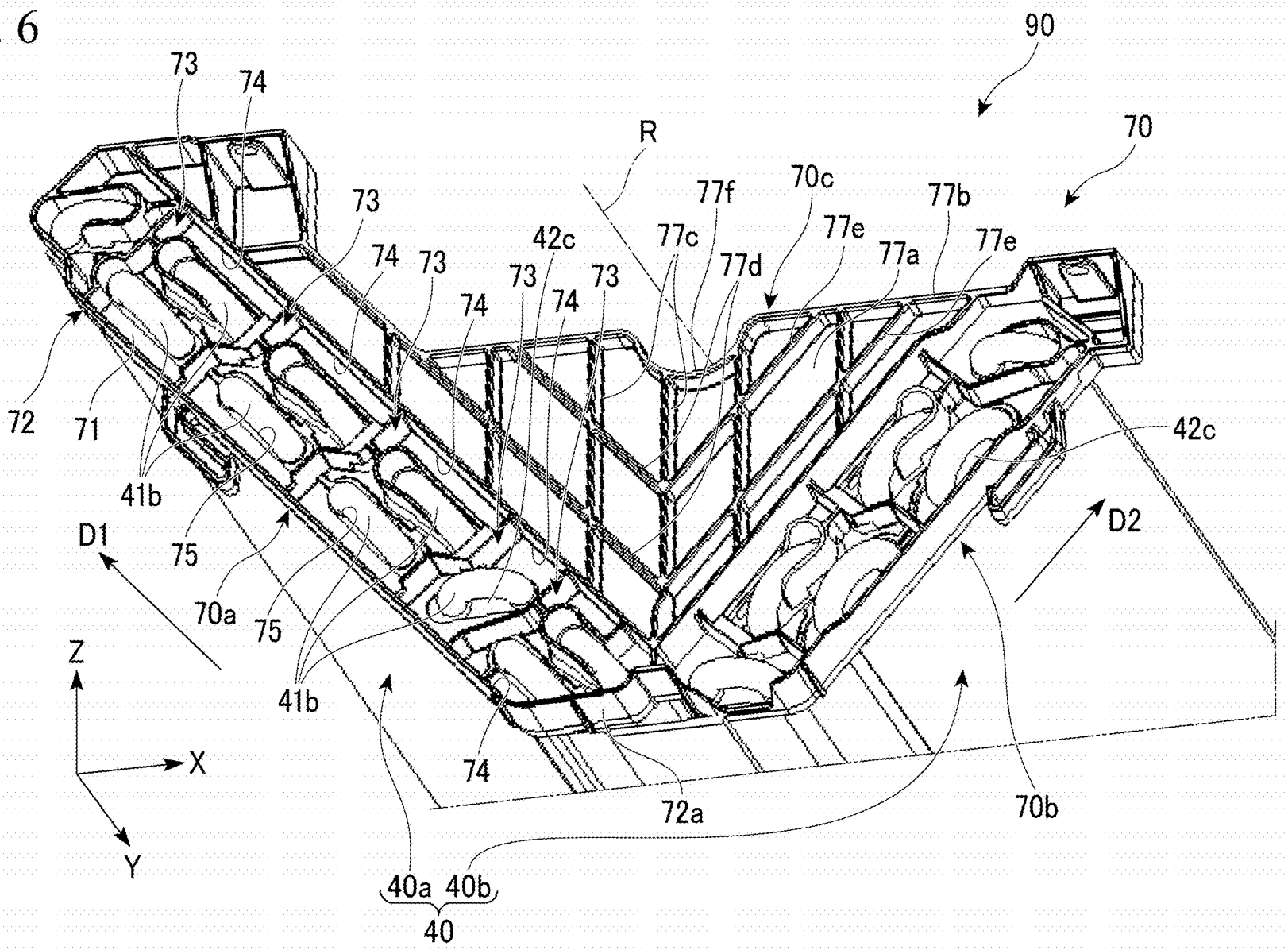
FIG. 6 A perspective view that shows a portion of the heat exchanger in the embodiment.
Figure 7:
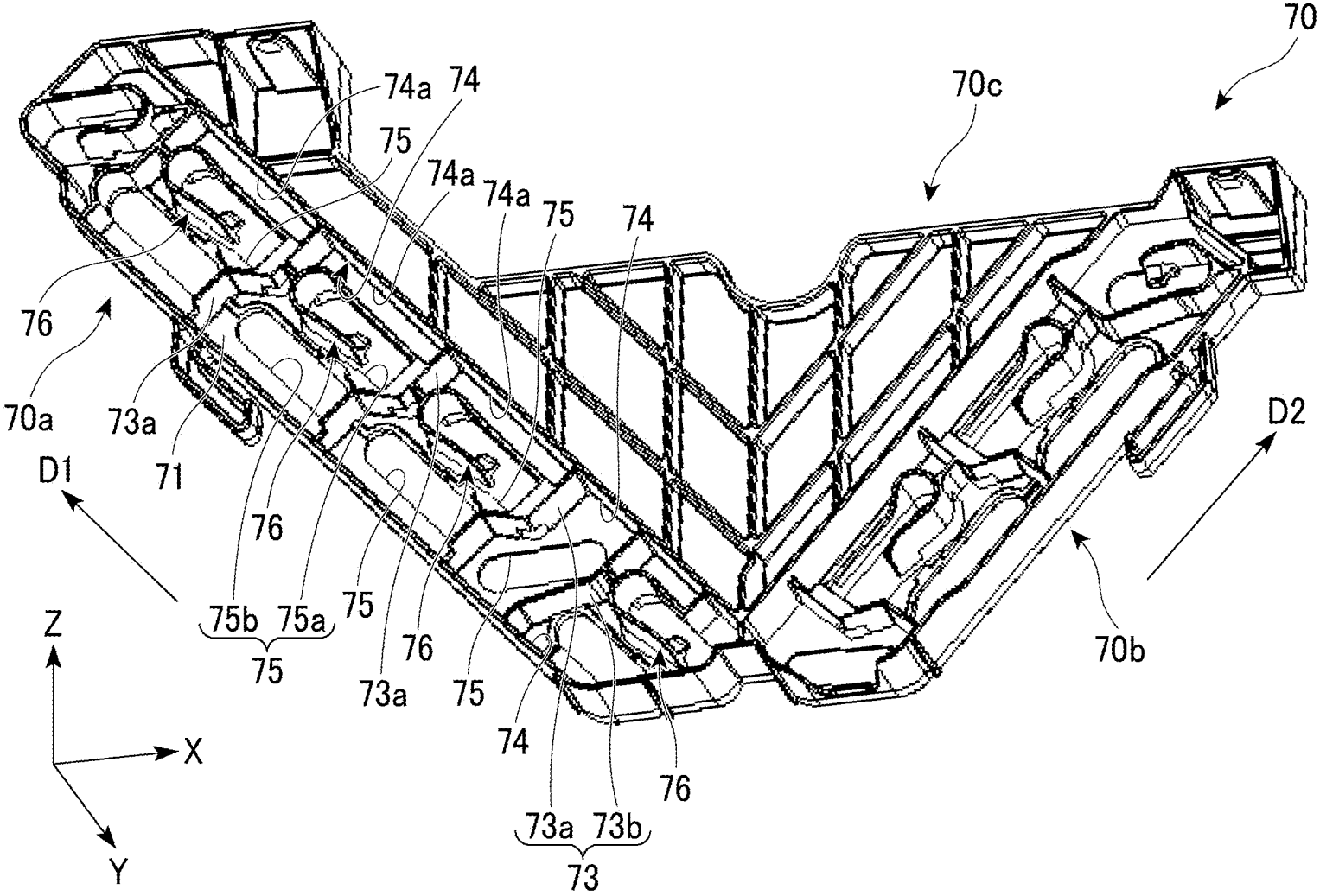
FIG. 7 A perspective view that shows the holder in the embodiment.
Figure 8:
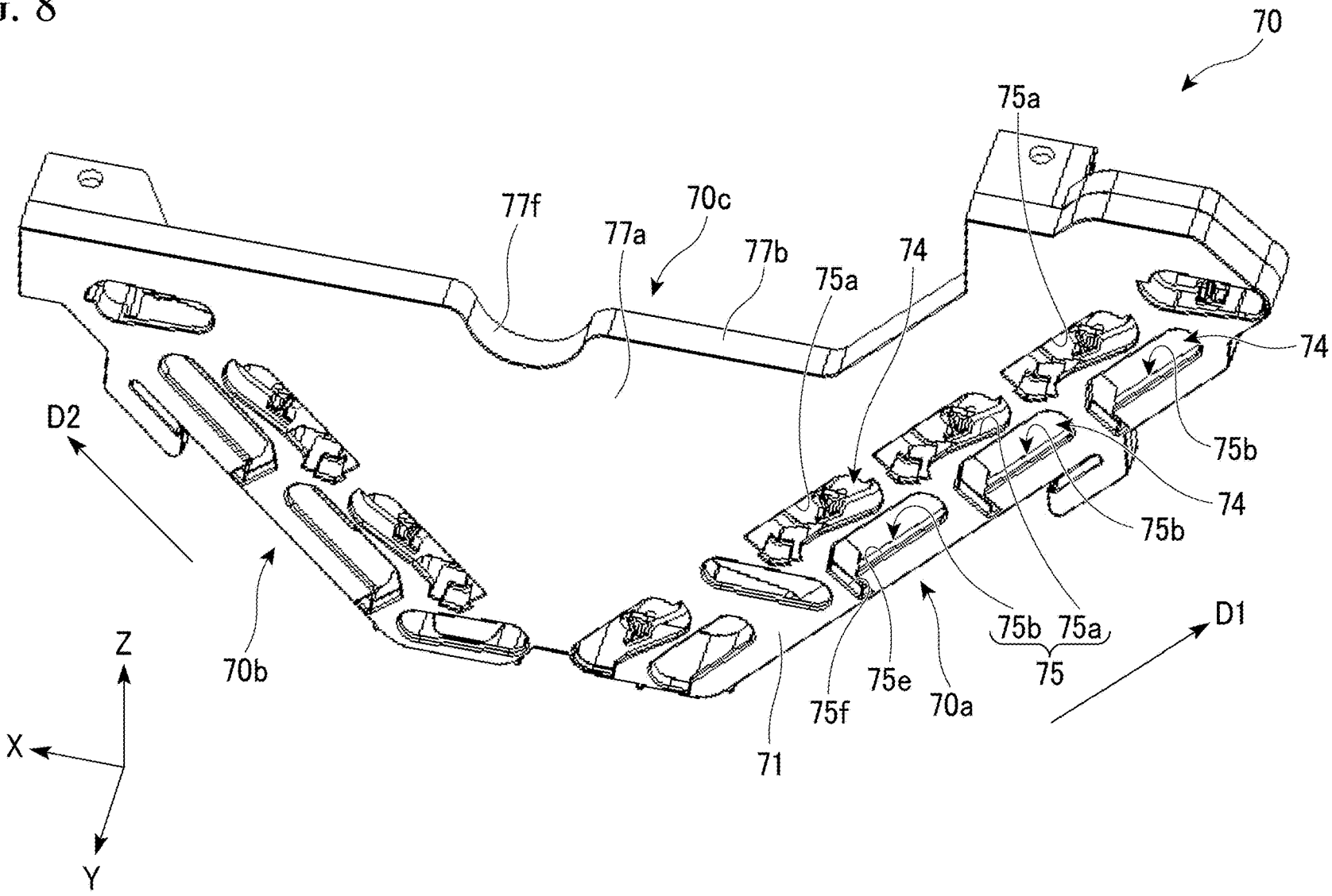
FIG. 8 A perspective view that shows the holder, and is a view that shows the holder from a different angle than the angle of FIG. 7.
Figure 9:
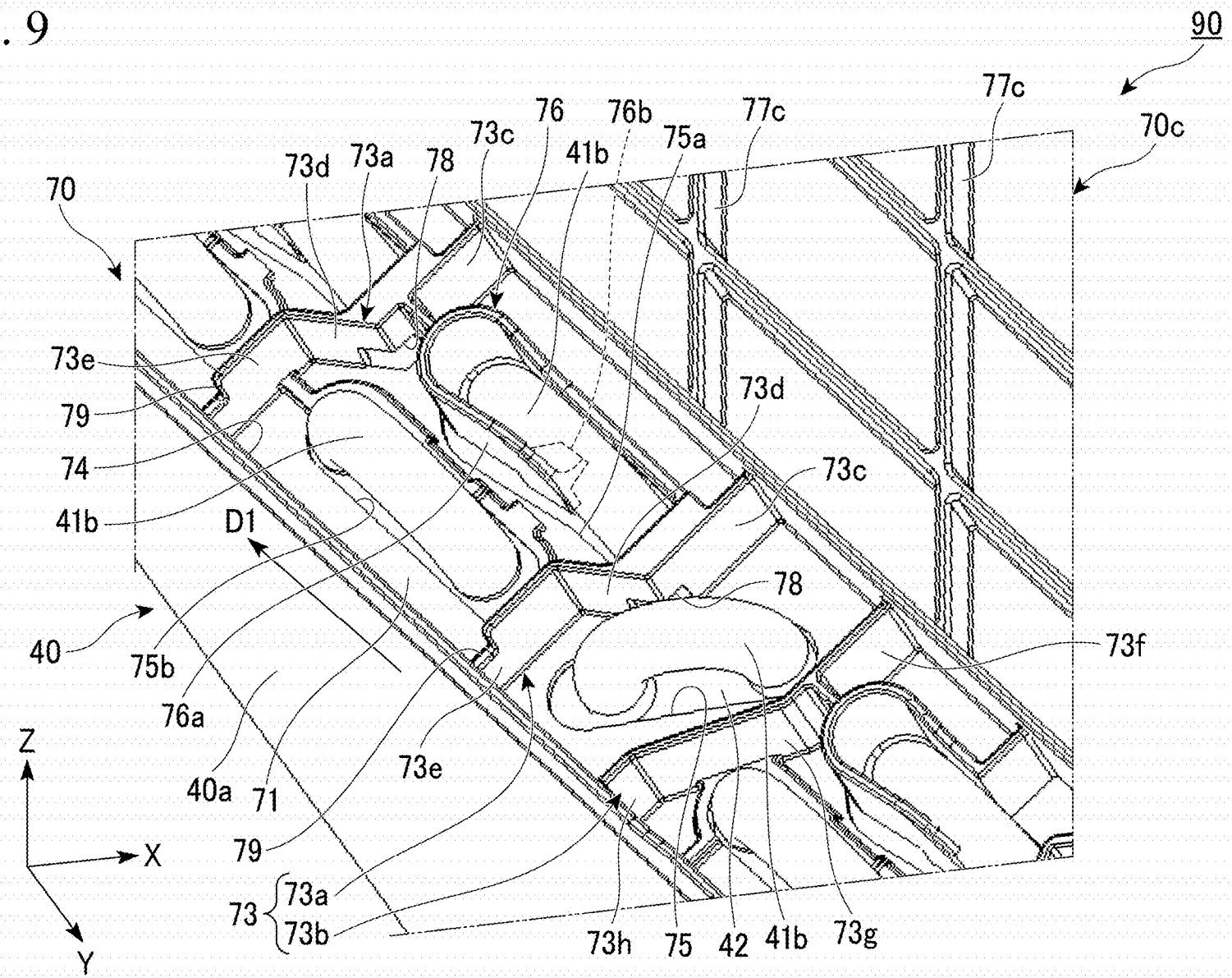
FIG. 9 A perspective view that shows portion of a heat exchanger main body and a portion of the holder in the embodiment.
Figure 10:
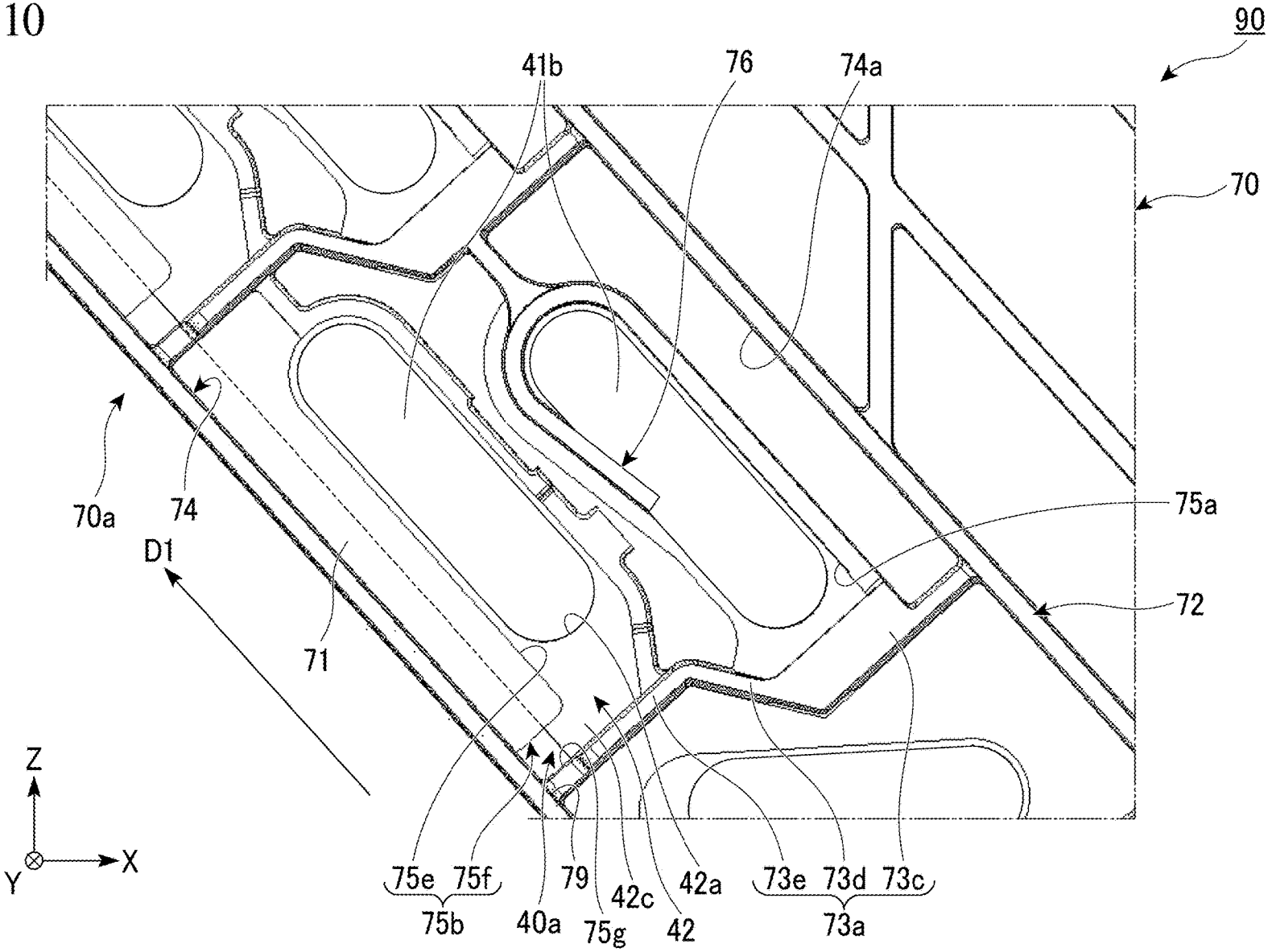
FIG. 10 A view that shows a portion of the heat exchanger main body and a portion of the holder in the embodiment, seen from the left side.
Figure 11:
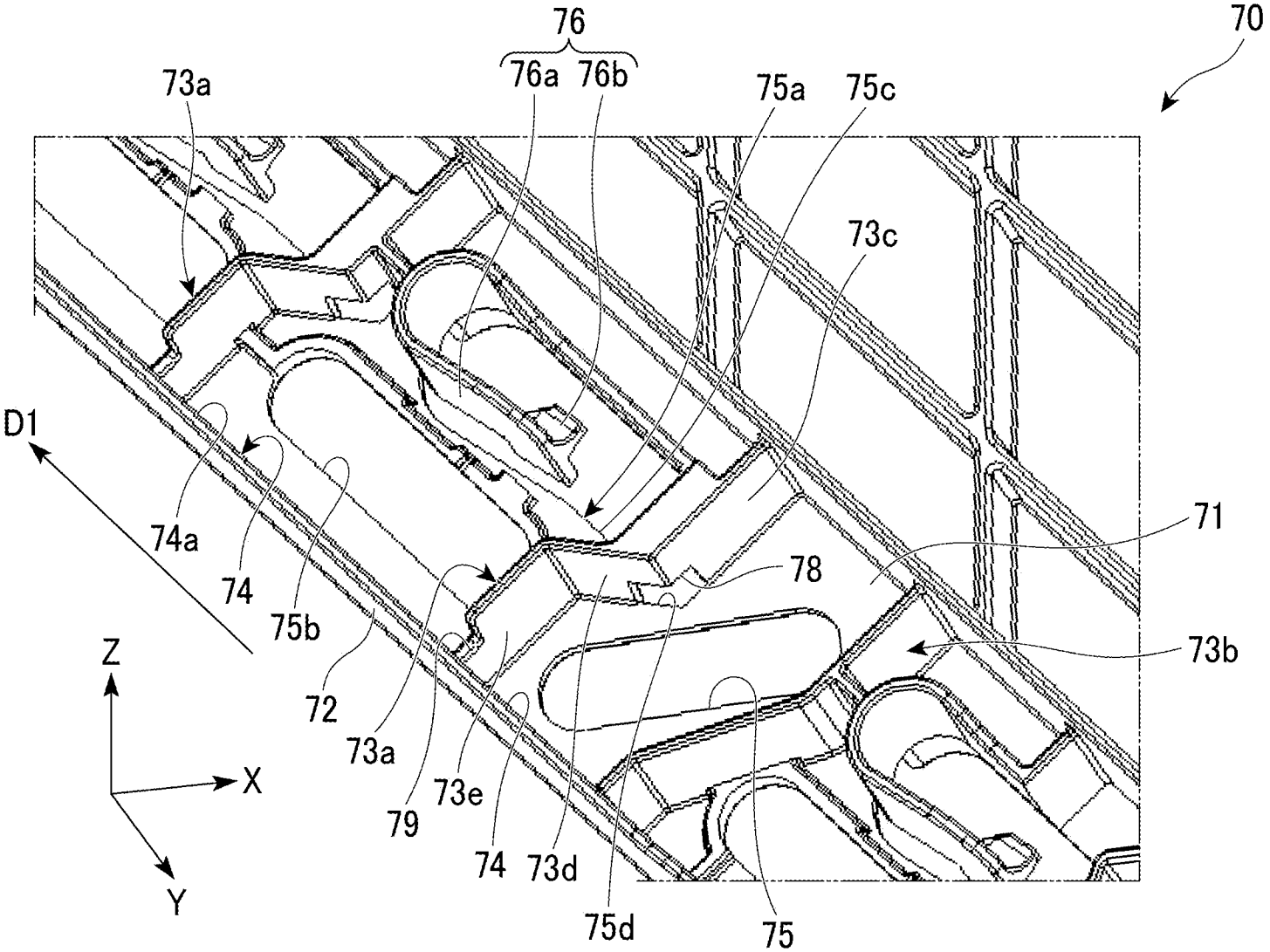
FIG. 11 A perspective view that shows a portion of the holder in the embodiment.
Figure 12:
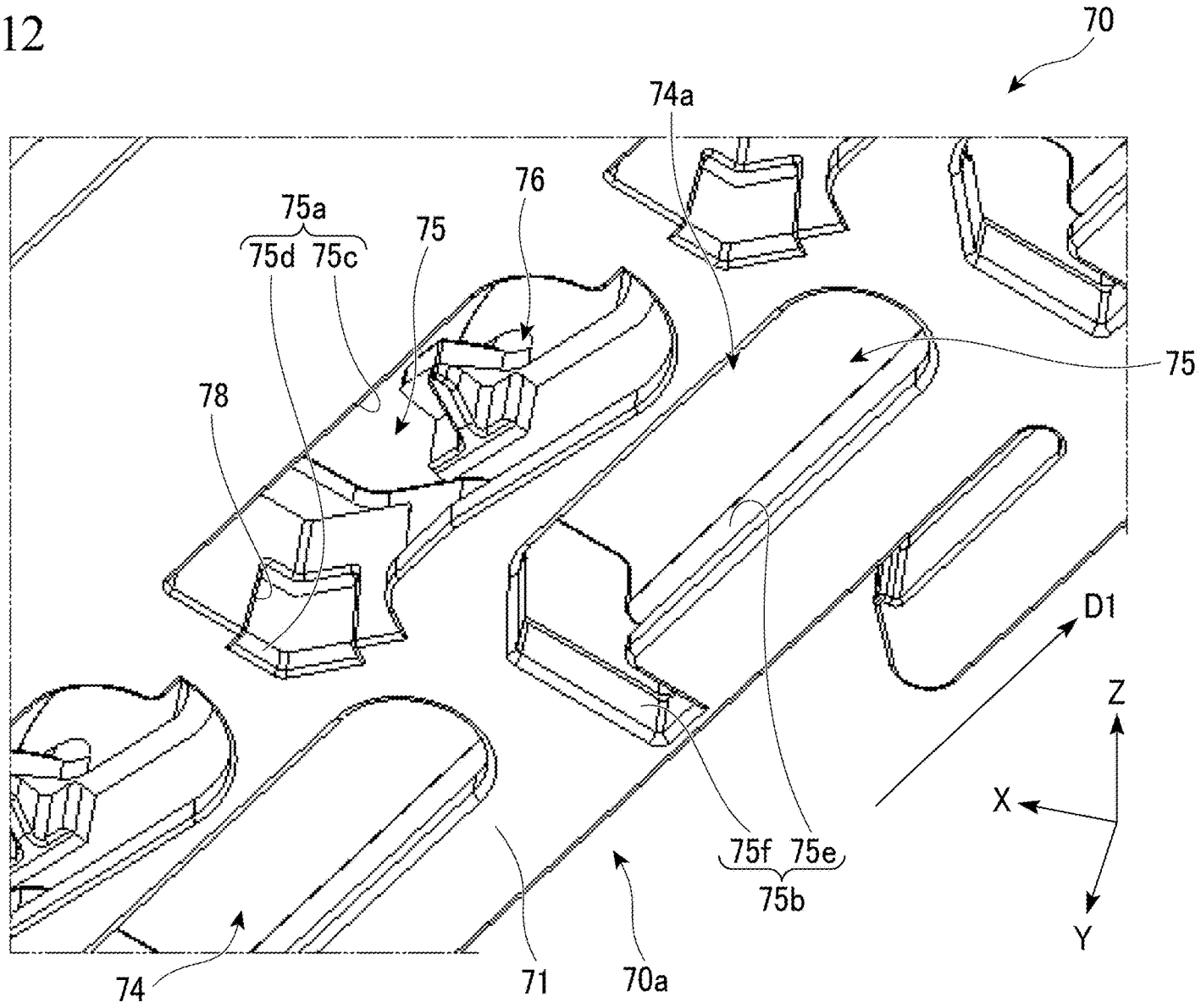
FIG. 12 A perspective view that shows a portion of the holder in the embodiment, and is a view that shows the part of the holder from a different angle than the angle of FIG. 11.

FIG. 6 is a perspective view that shows a part of the heat exchanger 90. FIG. 7 is a perspective view that shows the holder 70. FIG. 8 is a perspective view that shows the holder 70, and is a view that shows the holder 70 from a different angle than the angle of FIG. 7. FIG. 9 is a perspective view that shows a portion of the heat exchanger main body 40 and a portion of the holder 70. FIG. 10 is a view that shows a portion of the heat exchanger main body 40 and a portion of the holder 70, seen from the left side (−Y side). FIG. 11 is a perspective view that shows a portion of the holder 70. FIG. 12 is a perspective view that shows a portion of the holder 70, and is a view that shows the portion of the holder 70 from a different angle than the angle of FIG. 11.

As shown on FIG. 6, the holder 70 is located on the left side (−Y side) of the heat exchanger main body 40. The holder 70 is a member for increasing rigidity of the heat exchanger 90. The holder 70 is a member that suitably changes a flow of air that passes through the heat exchanger main body 40. The holder 70 is a member that protects the fold portion 41*b*. The holder 70 in the present embodiment is made of resin. The holder 70 may be made of metal.

As shown in FIG. 4, the holder 70 is located on the bottom side of the side wall 32 of the air flow path member 30. The holder 70 is for example, fixed to the side wall 32 using bolts. An end on the left side (−Y side) of the space in which the blower 50 is disposed in is closed off by the side wall 32, and a fixing wall 70*c* of the holder 70 to be mentioned later on. The space in which the blower 50 is disposed in is the space in the vertical direction, located between the heat exchanger main body 40 and the air flow path member 30. The space in which the blower 50 is disposed in includes the space in the front-rear X direction, located between the first heat exchanger portion 40*a* and the second heat exchanger portion 40*b*. By closing off the end on the left side of the space in which the blower 50 is disposed in, it is possible to suppress air that passed the heat exchanger main body 40 from leaking from the end on the left side of said space. As such, it becomes easier to have air that flows to the heat exchanger main body 40 suitably flow easily with respect to a part where the fins 42 out of the heat exchanger main body 40 are disposed. Therefore, it is easier to suitably conduct heat exchange between air and the refrigerant 19, and it becomes easier to suitably guide air that passes through the heat exchanger main body 40 to the blower 50 so as to flow to the air flow path 31.

As shown in FIG. 6 to FIG. 8, the holder 70 has a first holder portion 70*a*, a second holder portion 70*b*, and the fixing wall 70*c*. The first holder portion 70*a* extends in the first diagonal direction D1. The second holder portion 70*b* extends in the second diagonal direction D2. The first diagonal direction D1 is the second direction which intersects the horizontal direction, in the first holder portion 70*a*. The second diagonal direction D2 is the second direction which intersects the horizontal direction, in the second holder portion 70*b*.

The first holder portion 70*a* is located on the rear side (−X side) of the second holder portion 70*b*. A bottom end of the first holder portion 70*a* and a bottom end of the second holder portion 70*b* are connected to one another. The first holder portion 70*a* and the second holder portion 70*b* move apart from one another in the front-rear X direction, as the top side is approached. A shape of a portion formed by the first holder portion 70*a* and the second holder portion 70*b* out of the holder 70 as seen in the left-right direction Y is a semi V shape, and is roughly the same shape as the shape of the heat exchanger main body 40 seen in the left-right direction Y. A top end of the first holder portion 70*a* is located on the top side, more than a top end of the second holder portion 70*b*.

As shown in FIG. 6, the first holder portion 70*a* is located on the left (−Y side) of the first heat exchanger portion 40*a*. The first holder portion 70*a* is in contact with a fin 42*c*, which is the fin located on the left most side, out of the plurality of fins 42 of the first heat exchanger portion 40*a*. The second holder portion 70*b* is located on the left side of the second heat exchanger portion 40*b*. The second holder portion 70*b* is in contact with the fin 42*c*, which is the fin located on the left most side, out of the plurality of fins 42 of the second heat exchanger portion 40*b*.

The first holder portion 70*a* has a base 71, a peripheral wall 72, and a plurality of partition walls 73. The base 71 is a plate that has a plate surface which opens to the left-right direction Y, and that extends in the first diagonal direction D1. The base 71 is located on the left side (−Y side) of the heat exchanger main body 40. The peripheral wall 72 protrudes to the left side, from an outside peripheral edge of the base 71. By the base 71 and the peripheral wall 72, the first holder portion 70*a* extends in the first diagonal direction D1, and forms a semi-rectangular shaped box that opens to the left side. Bottom wall 72*a* located on the most bottom side out of the peripheral wall 72, roughly extends parallel to the front-rear direction X.

The plurality of partition walls 73 are located on the inside of the peripheral wall 72. The plurality of partition walls 73 protrude to the left side (−Y side) from the base 71. The plurality of partition walls 73 are provided in the first diagonal direction D1 with intervals therebetween. Each of the partition walls 73, as a whole, extends in a direction that is orthogonal with both the left-right direction Y and the first diagonal direction D1.

The plurality of the partition walls 73 partition an inside of the peripheral wall 72 in the first diagonal direction D1 which intersects the horizontal direction. A plurality of accommodations 74 that align in the first diagonal direction D1 are formed using the base 71, the peripheral wall 72, and the plurality of the partition walls 73. The accommodations 74 that are adjacent to one another in the first diagonal direction D1 are partitioned by the partition wall 73. Five partition walls 73 are provided in the first holder portion 70*a* of the present embodiment, and six accommodations 74 are provided. By providing the partition walls 73, it is possible to insure rigidity of the first holder portion 70*a* for example, even if a wall that surrounds the fold portion 41*b* for each of the fold portions 41*b* is not provided.

As shown in FIG. 7, a through hole 75 is formed on the base 71 in each of the plurality of the accommodations 74. One or two of the through hole 75 is formed on the base 71 of each accommodation 74. As shown in FIG. 6, one fold portion 41*b* is passed through each through hole 75. The fold portion 41*b* that is inserted through the through hole 75 has at least a portion thereof housed on an inside of the accommodation 74. In the present embodiment, an entirety of the fold portion 41*b* that is inserted through the through hole 75 is housed on the inside of the accommodation 74. An end on the left side (−Y side) of the fold portion 41*b* that is inserted through the through hole 75 is located on the right side (+Y side), more than an end on the left side of the peripheral wall 72 and an end on the left side of the partition wall 73.

As shown in FIG. 9 and in FIG. 10, an inside edge of the through hole 75 is disposed apart from the fold portion 41*b*. A gap between the inside edge of the through hole 75 and the fold portion 41*b*, is provided over the entire periphery that surrounds the fold portion 41*b*. A wall portion that surrounds the fold portion 41*b* is not provided on a peripheral edge of the through hole 75. The fold portion 41*b* that is inserted through the through hole 75 is disposed apart from the peripheral wall 72 and the partition wall 73. Each distance between the fold portion 41*b* and the peripheral wall 72, and between the fold portion 41*b* and the partition wall 73, is larger than a distance between the inside edge of the through hole 75 and the fold portion 41*b*.

A plurality of through holes 75 includes a first through hole 75*a*, and a second through hole 75*b*. One of each of the first through hole 75*a* and the second through hole 75*b* are formed on the base 71 of a portion of the accommodation 74, out of the plurality of accommodations 74. As shown in FIG. 4, on the first holder portion 70*a*, excluding each of the accommodation 74 located on the top most side out of four accommodations 74 that are located on the top side more than a drain pan 60 to be mentioned later on, three accommodations 74 having one of each of the first through hole 75*a* and the second through hole 75*b* formed are three top side accommodations 74*a*.

As shown in FIG. 11 and FIG. 12, in each of the top side accommodations 74*a*, the first through hole 75*a* and the second through hole 75*b* are disposed so as to align in a direction that is orthogonal to both the left-right Y direction and the first diagonal direction D1. Each of the first through hole 75*a* and the second through hole 75*b* is a long hole that extends in the first diagonal direction D1. The first through hole 75*a* is located on the front side (+X side) of the second through hole 75*b*. First through holes 75*a* are disposed so as to be adjacent to one another, on a side closer to the blower 50 than the second through hole 75*b*. In each of the top side accommodations 74*a*, the first through hole 75*a* is disposed so as to offset to the other side (−D1 side) of the first diagonal direction D1, more than the second through hole 75*b*. As such, in each of the top side accommodations 74*a*, the fold portion 41*b* that is inserted through the first through hole 75*a* is disposed so as to be offset to the other side of the first diagonal direction D1, more than the fold portion 41*b* that is passed through the second through hole 75*b*.

As shown in FIG. 10, an entirety of the first through hole 75*a* overlaps with the fin 42, as seen in the left-right direction Y. A portion of the fin 42*c* that is located on the left most side (−Y side) out of the plurality of fins 42 is exposed via a portion that excludes a portion through which the fold portion 41*b* is inserted, out of the first through hole 75*a*. As shown in FIG. 12, the first through hole 75*a* has a first hole main body 75*c* which is a long hole that is long in the first diagonal direction D1, and a first protruding hole 75*d* that protrudes to the bottom side in the vertical direction Z from a bottom end of the first hole main body 75*c*. As shown in FIG. 11, the first protruding hole 75*d* is formed on a location that overlaps with the first partition wall 73*a* to be mentioned later on, out of the partition wall 73, as seen in the left-right direction Y.

As shown in FIG. 10, as seen in the left-right direction Y, excluding a portion of an entirety thereof, the second through hole 75*b* overlaps with the fin 42. Out of the portion that overlaps with the fin 42 on the second through hole 75*b* in the left-right direction Y, the portion of the fin 42*c* located on the left most side (−Y side) out of the plurality of fins 42 protrudes via a portion that excludes a portion through which the fold portion 41*b* is inserted. The second through hole 75*b* has a second hole main body 75*e* that extends as a long hole shape in the first diagonal direction D1, and a second protruding hole 75*f* that protrudes to the bottom side and as the rear side (−X side) from an end located on the bottom side out of an end of the second hole main body 75*e* in the first diagonal direction D1. Out of the second protruding hole 75*f*, a portion of the side that is apart from the second hole main body 75*e* is an outside hole 75*g* that is located on an outside of the fin 42, as seen in the left-right direction Y. In other words, the second through hole 75*b* in the present embodiment is the through hole 75 having the outside hole 75*g*. The outside hole 75*g* is formed on a portion that protrudes to the bottom side and the rear side, more than the fin 42 out of the base 71.

As shown in FIG. 7, the plurality of the partition walls 73 include the first partition wall 73*a*, and the second partition wall 73*b*. In the present embodiment, the first partition wall 73*a* refers to the three walls located between the partition wall 73 located on the top most side, and the partition wall 73 located on the bottom most side, out of the five partition walls 73. A plurality of first partitions 73*a* are provided in plurality on the first diagonal direction D1, with intervals therebetween. The second partition wall 73*b* in the present embodiment refers to the partition wall located on the bottom most side out of the five partition walls 73. The second partition wall 73*b* is located on the bottom side in the vertical direction Z more than the plurality of first partition walls 73*a*.

The first partition wall 73*a* is the partition wall 73 which configures a wall portion in the other side (−D1 side) of the first diagonal direction D1, on the top side accommodation 74*a* where the first through hole 75*a* and the second through hole 75*b* are formed on the base 71. As shown in FIG. 4, all of the first partition walls 73*a* are located on the top side, more than an end on the top side of the drain pan 60 to be mentioned later on, on the first holder portion 70*a*. As shown on FIG. 10 and FIG. 11, the first partition wall 73*a* has first diagonal walls 73*c*, and 73*d*, and a second diagonal wall 73*e*.

The first diagonal wall 73*c* extends in a direction that is orthogonal to both the left-right direction Y and the first diagonal direction D1. An end on the top side and the front side (+X side) of the first diagonal wall 73*c* is connected to a wall portion that is on the top side and the front side, out of the peripheral wall 72. The first diagonal wall 73*c* is located on the bottom side, as the rear side (−X side) is approached. The first diagonal wall 73*d* extends diagonally to the top side and the rear side, from an end on the bottom side and the rear side of the first diagonal wall 73*c*. The first diagonal wall 73*d* extends in a direction that is orthogonal to the left-right direction Y, while intersecting the front-rear direction X, the vertical direction Z, and the first diagonal direction D1. The first diagonal wall 73*d* is located on the bottom side, as the front side is approached. The first diagonal wall 73*c* and the first diagonal wall 73*d* extend in a direction that is located on the bottom side of the vertical direction Z, as a first through portion 78, to be mentioned later on, is approached.

The second diagonal wall 73*e* extends diagonally to the bottom side and the rear side, from an end on the top side and the rear side (−X side) of the first diagonal wall 73*d*. The second diagonal wall 73*e* extends in the same direction that the first diagonal wall 73*c* extends in. In other words, the second diagonal wall 73*e* extends in a direction that is orthogonal to both the left-right direction Y and the first diagonal direction D1. The second diagonal wall 73*e* is located on the bottom side as the rear side is approached. The second diagonal wall 73*e* extends in a direction that is located on the bottom side of the vertical direction Z, as a second through portion 79, to be mentioned later on, is approached. An end on the bottom side and the rear side of the second diagonal wall 73*e* is connected to a wall portion on the bottom side and the rear side, out of the peripheral wall 72. The second diagonal wall 73*e* is located on the one side (+D1 side) of the first diagonal direction D1, more than the first diagonal wall 73*c*.

As shown in FIG. 9, the first through portion 78 which penetrates the first partition wall 73*a*, is formed as a through portion on the first partition wall 73*a*. The first through portion 78 is a through portion that is formed on a portion that overlaps with the fin 42, out of the first partition wall 73*a*, as seen in the left-right direction Y. The first through portion 78 in the present embodiment is a through portion that is formed so as to straddle the first diagonal wall 73*c* and the first diagonal wall 73*d*, on a connection portion of the first diagonal wall 73*c* and the first diagonal wall 73*d*. The first through portion 78 penetrates the first diagonal wall 73*c* and the first diagonal wall 73*d* in the vertical direction Z, through the connection portion of the first diagonal wall 73*c* and the first diagonal wall 73*d*.

The first through portion 78 is formed on an end of a side connected to the base 71 out of the first partition wall 73*a*, in other words, of a side (+Y side) where the fin 42 is located, in the left-right direction Y. As shown in FIG. 12, the first through portion 78 is connected to the first protruding hole 75*d* of the first through hole 75*a*. Accordingly, the first through portion 78 is connected to the through hole 75. The first through portion 78 in the present embodiment is a rectangular shaped hole that is formed from two portions, one being formed on the first diagonal wall 73*c*, and the other being formed on the first diagonal wall 73*d*.

As shown in FIG. 10 and FIG. 11, the second through portion 79 which penetrates the first partition wall 73*a*, is formed as a through portion on the first partition wall 73*a*. The second through portion 79 is a through portion that is formed on a portion that is located on the outside of the fin 42, out of the first partition wall 73*a*, as seen in the left-right direction Y. The second through portion 79 in the present embodiment is formed on an end of the side that connects to the peripheral wall 72 out of the second diagonal wall 73*e*. The second through portion 79 penetrates the end of the side that connects to the peripheral wall 72 out of the second diagonal wall 73*e*, in the first diagonal direction D1.

The second through portion 79 is formed on an end of an opposite side to the side that connects to the base 71 out of the first partition wall 73*a*, in other words, an end on an opposite side (−Y side) to the side that the fin 42 is located on, in the left-right direction Y. The second through portion 79 opens to the left side (−Y side). As shown in FIG. 10, the second through portion 79 is formed on a location that is adjacent to the other side (−D1 side) in the first diagonal direction D1 of the outside hole 75*g*, as seen in the left-right direction Y. The second through portion 79 is formed apart from the outside hole 75*g* in the left-right direction Y. In other words, the second through portion 79 is disposed apart on the left side of the outside hole 75*g*. The second through portion 79 is not connected to the through hole 75. The second through portion 79 in the present embodiment is a rectangular cut through hole.

As shown in FIG. 9, the second partition wall 73*b* has diagonal walls 73*f*, 73*g*, and 73*h*. The diagonal wall 73*f* extends in a direction that is orthogonal to both the left-right direction Y and the first diagonal direction D1. An end on the top side and on the front side (+X side) of the diagonal wall 73*f* is connected to a wall portion on the top side and on the front side out of the peripheral wall 72. The diagonal wall 73*f* is located on the bottom side, as the rear side (−X side) is approached. The diagonal wall 73*g* extends diagonally to the bottom side and the rear side from an end on the bottom side and the rear side of the diagonal wall 73*f*. The diagonal wall 73*g* slightly extends in a direction that inclines to the vertical direction Z, with respect to the front-rear direction X. The diagonal wall 73*h* extends to the bottom side and to the rear side from an end on the bottom side and on the rear side of the diagonal wall 73*g*. The diagonal wall 73*h* extends in the same direction as the direction in which the diagonal wall 73*f* extends in. The diagonal wall 73*h* is located on the bottom side as the rear side is approached. An end on the bottom side and the rear side of the diagonal wall 73*h* is connected to a wall portion on the bottom side and the rear side out of the peripheral wall 72. The diagonal wall 73*h* is located on the one side (+D1 side) of the first diagonal direction D1, more than the diagonal wall 73*f*.

In contrast to the first partition wall 73*a*, a through portion that penetrates the second partition wall 73*b* is not formed on the second partition wall 73*b*. In the first holder portion 70*a* of the present embodiment, the through portion that penetrates the partition wall 73 is only formed on the first partition wall 73*a* out of the plurality of partition walls 73. As shown in FIG. 4, a bottom side portion of the second partition wall 73*b* is located on the bottom side more than an end on the top side of the drain pan 60 to be mentioned later on. The bottom side portion of the second partition wall 73*b* is located on an inside of the drain pan 60. A top side portion of the second partition wall 73*b* is located on the top side, more than an end on the top side of the drain pan 60.

As shown in FIG. 11, the first holder portion 70*a* has a mating portion 76 that is connected to the inside edge of the through hole 75. The mating portion 76 has an arm 76*a* that extends from the inside edge of the through hole 75, and a claw 76*b* that connects to a tip of the arm 76*a*. The arm 76*a* in the present embodiment extends from a portion on the top side out of the inside edge of the through hole 75 along the inside edge of the through hole 75 to the rear side (−X side), while curving in the bottom side and the front side (+X side). The arm 76*a* is a U shape that opens to the other side (−D1 side) of the first diagonal direction D1, as seen in the left-right direction Y. The arm 76*a* is elastically deformable. More specifically, the arm 76*a* elastically deforms to the rear side and the bottom side when being pushed from the right side (+Y side).

The claw 76*b* protrudes towards an inside of the through hole 75 from a tip of the arm 76*a*, as seen in the left-right direction Y. The claw 76*b* overlaps with what is roughly the center part in the first diagonal direction D1 of the through hole 75, as seen in the left-right direction Y. As shown in FIG. 9, the claw 76*b* hooks onto the fold portion 41*b* from the right side (+Y side). Accordingly, the holder 70 hooks onto the heat exchanger main body 40 in the left-right direction Y, and the holder 70 is attached to the heat exchanger main body 40.

The mating portion 76 in the present embodiment is only provided on a portion of the through holes 75 out of the plurality of through holes 75. The mating portion 76 is provided on three first through holes 75*a* out of the plurality of through holes 75, and on the through hole 75 that is located on the front side (+X side) out of the two through holes 75 formed in the accommodation 74 located on the bottom most side.

As shown in FIG. 4, the second holder portion 70*b* is roughly the first holder portion 70*a* inverted in the front-rear direction X. The second holder portion 70*b* has various parts that correspond to the base 71 of the first holder portion 70*a*, the peripheral wall 72, the partition wall 73, the accommodation 74, the through hole 75, and the mating portion 76. Said various parts in the second holder portion 70*b* are the same shapes as the various parts in the first holder portion 70*a*, inverted with respect to the front-rear direction X.

Three partition walls are provided in the second holder portion 70*b*. Excluding the partition wall on the top most side out of the three partition walls in the second holder portion 70*b*, remaining two partition walls are the first partition wall. The first partition in the second holder portion 70*b* is the shape of the first partition wall 73*a* in the first holder portion 70*a*, inverted in the front-back direction X. The partition wall in the second holder portion 70*b* does not include the partition wall that corresponds to the second partition wall 73*b* in the first holder portion 70*a*. Two accommodations provided in the second holder portion 70*b*, which correspond to the top side accommodation 74*a* formed on the first through hole 75*a* and the second through hole 75*b* in the first holder portion 70*a*, are provided. Each mating portion of the second holder portion 70*b* is provided on each penetration hole that corresponds to the first through hole 75*a*, out of said two accommodations.

In the second holder portion 70*b*, a direction that corresponds to the first diagonal direction D1 of the first holder portion 70*a* is the second diagonal direction D2. In explanations of effects and so on that follow, explanations pertaining to the effects in the first holder portion 70*a* serve to represent the effects in the second holder portion 70*b*. Therefore, explanations pertaining to the second holder portion 70*b* are omitted.

As shown in FIG. 6, the fixing wall 70*c* is located on the top side between the first holder portion 70*a* and the second holder portion 70*b*. The fixing wall 70*c* connects the first holder portion 70*a* and the second holder portion 70*b* in the front-rear direction X. The fixing wall 70*c* is a semi-triangular shape having an angle on the bottom side, as seen in the left-right direction Y. A depression 77*f* that concaves to the bottom side is formed on a center part in the front-rear direction X, on an edge on the top side of the fixing wall 70*c*. An inside edge of the depression 77*f* is a circular arc that concaves to the bottom side, having an axis of rotation R of the blower 50 as a center thereof. The fixing wall 70*c* has a plate 77*a*, an edge wall 77*b*, a vertical rib 77*c*, a first diagonal rib 77*d*, and a second diagonal rib 77*e*.

The plate 77*a* is a semi-triangular shape that has an angle on the bottom side, as seen in the left-right direction Y. The edge wall 77*b* protrudes to the left side (−Y side) from an edge on the top side of the plate 77*a*. The edge wall 77*b* extends in the front-rear direction X. The vertical rib 77*c* protrudes to the left side from the plate 77*a*, and extends in the vertical direction Z. The vertical rib 77*c* connects the edge wall 77*b* with the peripheral wall 72 of the plate 77*a*, or with the peripheral wall of the second holder portion 70*b*. A plurality of vertical ribs 77*c* are provided in the front-rear direction X, with intervals therebetween.

The first diagonal rib 77*d* protrudes to the left side (−Y side) from a portion located on the top side of the first holder portion 70*a*, out of the plate 77*a*. The first diagonal rib 77*d* extends in the first diagonal direction D1. A plurality of first diagonal ribs 77*d* are provided in the vertical direction Z, with intervals therebetween. The first diagonal rib 77*d* intersects the vertical rib 77*c*.

The second diagonal rib 77*e* protrudes to the left side (−Y side) from a portion located on the top side of the second holder portion 70*b*, out of the plate 77*a*. The second diagonal rib 77*e* extends in the second diagonal direction D2. A plurality of second diagonal ribs 77*e* are provided in the vertical direction Z, with intervals therebetween. The second diagonal rib 77*e* intersects the vertical rib 77*c*.

As shown in FIG. 4, a shape of an edge on the top side of the fixing wall 70*c* is the shape along an edge on the bottom side of the side wall 32 of the air flow path member 30. The edge on the top side of the fixing wall 70*c* is in contact with the edge on the bottom side of the side wall 32. Both ends in the front-rear direction X out of the fixing wall 70*c* are each fixed to the side wall 32, using bolts for example.

The indoor unit 11 includes the drain pan 60 that is located on the bottom side of the heat exchanger 90. It is possible for the drain pan 60 to receive condensation water that forms on an outer surface of the heat exchanger main body 40. Condensation water that is retained by the drain pan 60 is discharged to the outside using a drain pump that is not shown on the drawings. A dimension in the front-rear direction X of the drain pan 60, is larger than a dimension in the front-rear direction X of the heat exchanger 90. The drain pan 60 is a member having a tray shape, which opens to the top side.

Figure 13:
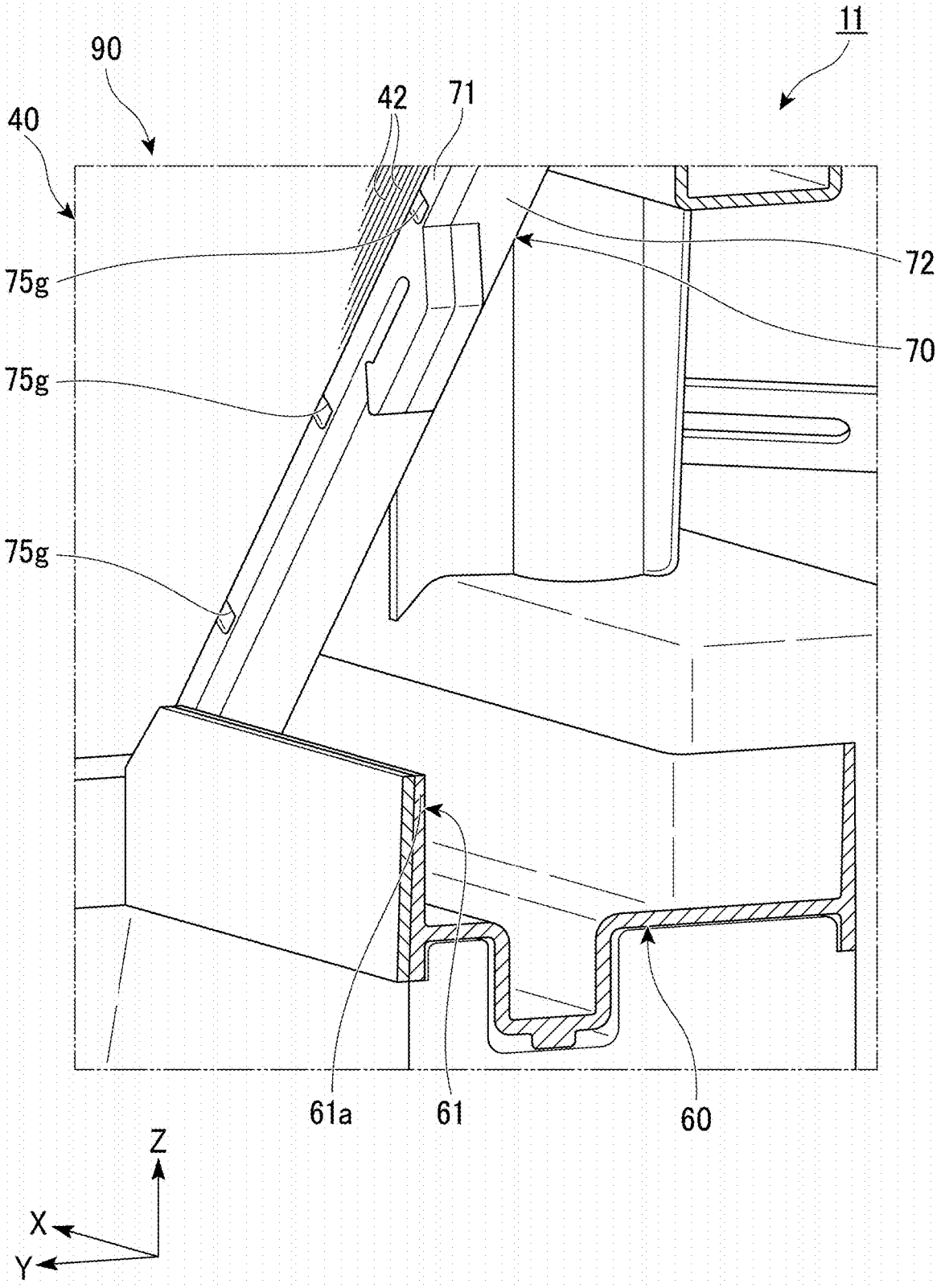
FIG. 13 A partial cross-sectional perspective view that shows a portion of the heat exchanger and a portion of a drain pan in the embodiment.

FIG. 13 is a partial cross-sectional perspective view that shows a portion of the heat exchanger 90 and a portion of the drain pan 60. As shown in FIG. 13, the drain pan 60 has a receiver 61 located on the bottom side of the holder 70. The receiver 61 extends in the front-rear direction X. A side wall 61*a* located on a side (+Y side) closer to a center part in the left-right direction Y of the heat exchanger 90 out of the receiver 61, is slightly located on a side (+Y side) of the fin 42, more than the base 71 of the holder 70 in the left-right direction Y. The side wall 61*a* is located on the bottom side of the fin 42 that is disposed on a location closer to the holder 70, out of the plurality of fins 42.

Although not shown on the drawings, the drain pan 60 has a receiver that extends in the left-right direction Y, and is located on the bottom side of a connection portion of the first heat exchanger portion 40*a* and the second heat exchanger portion 40*b*, and has a receiver that extends in the front-rear direction X, and is located on the bottom side of an end on the right side (+Y side) of the heat exchanger main body 40. Due to said two receivers and to the aforementioned receiver 61, a shape of the drain pan 60 is roughly an H shape, as seen in the vertical direction Z.

According to the present embodiment, the holder 70 has the base 71 that is located on the left side (−Y side) of the heat exchanger main body 40, the peripheral wall 72 that protrudes to the left side from the outside peripheral edge of the base 71, and the partition wall 73 that partitions the inside of the peripheral wall 72 in the first diagonal direction D1 which intersects the horizontal direction. The plurality of accommodations 74 that align in the first diagonal direction D1 are formed by the base 71, the peripheral wall 72, and the partition wall 73. The through hole 75, through which the fold portion 41*b* is inserted, is formed on each base 71 on the plurality of accommodations 74. The inside edge of the through hole 75 is disposed apart from the fold portion 41*b*. As such, condensation water that forms on the outer surface of the fold portion 41*b* is suppressed from accumulating between the fold portion 41 and the through hole 75, and it is possible to easily discharge the condensation water to an outside of the accommodation 74 via the through hole 75. Condensation water that is discharged from the through hole 75 comes into contact with an outer surface of the fin 42*c* provided on a location that is closest to the holder 70 out of the fin 42, and flows to the bottom side in the vertical direction Z along the fin 42*c*, so as to flow to the inside of the drain pan 60.

According to the present embodiment, the partition wall 73 includes the first partition wall 73*a*. The first through portion 78 and the second through portion 79 are formed on the first partition wall 73*a*, as through portions that penetrate the first partition wall 73*a*. As such, even in a case where at least a portion of the condensation water that forms on the outer surface of the fold portion 41*b* does not flow to the through hole 75, but instead flows to the top of the first partition wall 73*a*, it is possible to discharge condensation water that flows to the top of the first partition wall 73*a* from the inside of the accommodation 74 to the bottom side in the vertical direction Z, via the first through portion 78 or the second through portion 79.

As in the above, according to the present embodiment, it is possible to discharge condensation water that forms on the outer surface of the fold portion 41*b* to the outside of the accommodation 74, through the through hole 75, or through each of the through portions. As such, it is possible to suppress having water condensation accumulate on the inside of the accommodation 74 of the holder 70. Accordingly, it is possible prevent having condensation water continuously contact the fold portion 41*b* on the inside of the accommodation 74, making it possible to suitably suppress corrosion of the fold portion 41*b*. Therefore, it is possible to suitably suppress leaking of the refrigerant 19 from the heat transfer pipe 41. As such, it is possible to lengthen service life of the heat exchanger 90.

At least a portion of the condensation water that is discharged to the bottom side from the accommodation 74 via the first through portion 78 or the second through portion 79, is discharged from the through hole 75 on another accommodation 74 that is located on the bottom side of said accommodation 74, and flows to the drain pan 60 along the fin 42 for example, as previously mentioned. Condensation water that is discharged to the bottom side from the inside of the accommodation 74 via the first through portion 78 or the second through portion 79 overflows to the left side (−Y side), after accumulating on the wall portion of the other accommodation 74 located on the bottom side of said accommodation 74, and it is possible for the accumulated water to flow to the inside of the drain pan 60, going through the heat exchanger 90.

It is possible for condensation water that flows to the top of the first partition wall 73*a* to spill to the left side (−Y side) from the first partition wall 73*a*, so as to be discharged from the inside of the accommodation 74. In such case, when a large amount of condensation water spills from the first partition wall 73*a*, there is a risk of the condensation water scattering and missing the drain pan 60. In contrast to this, according to the present embodiment, since it is easy for condensation water that flows to the top of the first partition wall 73*a* to be discharged using the first through portion 78 or the second through portion 79, it is possible to suppress the condensation water that spills to the left side from the first partition wall 73*a*, from becoming large. Accordingly, even if a portion of the condensation water spills to the left side from the first partition wall 73*a*, it is possible to prevent such condensation water from scattering, and it is possible to suppress the drain pan 60 from not being able to collect the scattering condensation water.

According to the present embodiment, the through portions that are formed on the first partition wall 73*a* include the first through portion 78 formed on the part that overlaps with the fin 42, as seen in the left-right direction Y, out of the first partition wall 73*a*. The first through portion 78 is formed on an end of a side that is connected to the base 71, out of the first partition wall 73*a*, and is connected to the through hole 75. As such, it is easy to have condensation water that flows from the top of the first partition wall 73*a* to the first through portion 78, to flow to the portion of the through hole 75 that is connected to the first through portion 78. Since the first through portion 78 and the fin 42 overlap, as seen in the left-right direction, it is possible to have the condensation water that is discharged from the portion of the through hole 75 that is connected with the first through portion 78 suitably contact the fin 42. Accordingly, it is possible to have the condensation water that is discharged from the portion of the through hole 75, which is connected to the first through portion 78, suitably pass by the outer surface of the fin 42 to the bottom side in the vertical direction Z, and it is possible to have the condensation water suitably flow to the inside of the drain pan 60.

According to the present embodiment, the first partition wall 73*a* has the first diagonal walls 73*c* and 73*d* that extend in a direction which is located on the bottom side of the vertical direction Z, as the first through portion 78 is approached. As such, it is possible to guide condensation water that flows to the top of the first diagonal walls 73*c* and 73*d* out of the first partition wall 73*a* to the first through portion 78, using gravity along the first diagonal walls 73*c* and 73*d*. Accordingly, discharging condensation water from the first through portion 78, or from the part of the through hole 75 that is connected to the first through portion 78 becomes easier.

According to the present embodiment, the through portion formed on the first partition wall 73*a* includes the second through portion 79, which is formed on the outside of the fin 42 as seen in the left-right direction Y, out of the first partition wall 73*a*. The through hole 75 includes the second through hole 75*b* that has the outside hole 75*g*, which is located on the outside of the fin 42. The second through portion 79 is formed apart from the outside hole 75*g* in the left-right direction Y. As such, there is no need to have the outside hole 75*g* be in contact with the second through hole 75*b*, and there is no need to form a large hole. Accordingly, it is possible to provide the second through portion 79 and the outside hole 75*g* so that it is easier to discharge condensation water from the inside of the accommodation 74, while making it difficult for the condensation water that is discharged from the outside hole 75*g* to scatter from the outside hole 75*g*.

Here, as shown in FIG. 13, when the outside hole 75*g* is located on the bottom side more than the fin 42, and the outside hole 75*g* opens to the center side (+Y side) in the left-right direction Y of the heat exchanger main body 40, if condensation water were to scatter from the outside hole 75*g*, the scattered water flies to the center side (+Y side) of the heat exchanger main body 40, as opposed to the side wall 61*a* on the receiver 61 of the drain pan 60, and there is a risk of the scattered condensation water not being collected in the drain pan 60. In contrast to this, according to the present embodiment, as previously mentioned, since it is possible to make it difficult for condensation water to scatter from the outside hole 75*g*, it is possible to suppress the condensation water that is discharged from the outside hole 75*g* from going anywhere but to the drain pan 60. Condensation water that is discharged from the outside hole 75*g* flows to the bottom side in the vertical direction Z, along an outer surface of the holder 70 or the outer surface of the fin 42, and flows to the inside of the receiver that is located on the bottom side of the connection portion of the first heat exchanger portion 40*a* and the second heat exchanger portion 40*b*, out of the drain pan 60. As such, it is possible to suitably collect condensation water that is discharged from the outside hole 75*g*, in the drain pan 60.

According to the present embodiment, the second through portion 79 is formed on an end of the opposite side (−Y side) to the side that is connected to the base 71, out of the first partition wall 73*a*, and opens to the left side (−Y side). As such, it is possible have the second through portion 79 be suitably separated from the outside hole 75*g*. It is possible to decrease a height of the protrusion of the first partition wall 73*a* on the part onto which the second through portion 79 is formed, and it is possible to have it to where it is difficult for condensation water that is discharged via the second through portion 79 to scatter to the left side (−Y side). Accordingly, it is possible to suppress not having the condensation water discharged via the second through portion 79 not be collected in the drain pan 60.

According to the present embodiment, the first partition wall 73*a* has the second diagonal wall 73*e*, which extends in a direction located on the bottom side of the vertical direction Z, as the second through portion 79 is approached. As such, it is possible to guide condensation water that flows to the top of the second diagonal wall 73*e* out of the first partition wall 73*a* to the second through portion 79, using gravity along the second diagonal wall 73*e*. Accordingly, it is possible to discharge condensation water from the second through portion 79 more easily.

According to the present embodiment, the plurality of first partition walls 73*a* are provided in the first diagonal direction D1, with intervals therebetween. The plurality of partition walls 73 include the second partition wall 73*b*, which is located on the bottom side of the vertical direction Z more than the plurality of first partition walls 73*a*. The through portions that include the first through portion 78 and the second through portion 79 are only formed on the plurality of partition walls 73, out of the first partition walls 73*a*. In other words, the through portion is not formed on the second partition wall 73*b*. As such, manufacturing of the holder 70 can be made easier by not having the through portion needing to be formed on all of the partition walls 73. Since the second partition wall 73*b* is also located on the bottom side of the vertical direction Z more than the first partition wall 73*a*, the second partition wall 73*b* is disposed in a location that it closer to the drain pan 60 than the first partition wall 73*a*. Accordingly, even when condensation water that spills from the second partition wall 73*b* scatters, it is very difficult for said scattered condensation water to not end up in the drain pan 60. Therefore, even if no through portion is formed on the second partition wall 73*b*, it is possible to suppress not having the condensation water be collected in the drain pan 60.

According to the present embodiment, the holder 70 has the mating portion 76, which is connected to the inside edge of the through hole 75. The mating portion 76 extends from the inside edge of the through hole 75, has the elastically deformable arm 76*a*, and the claw 76*b* that is connected to the tip of the arm 76*a*, and hooks to the fold portion 41*b* from the right side (+Y side). As such, it is possible to suppress the holder 70 from coming off of the heat exchanger main body 40 in the left-right direction Y, using the claw 76*b*. When attaching the holder 70 to the heat exchanger main body 40, the fold portion 41*b* is inserted from the right side to the through hole 75 that has the mating portion 76 provided on the inside edge thereof, and the claw 76*b* is depressed by the fold portion 41*b*, so the arm 76*a* elastically deforms. Accordingly, it is possible to easily insert the fold portion 41*b* to the inside of the through hole 75 having the mating portion 76 provided on the inside edge thereof. When the fold portion 41*b* is inserted deep enough to where the claw 76*b* is not in contact with the fold portion 41*b* anymore, the arm 76*a* restores its original shape, the claw 76*b* is inserted to the inside of the fold portion 41*b*, and the claw 76*b* hooks to the fold portion 41*b* from the right side. As such, according to the present embodiment, it is possible to easily hook the claw 76*b* to the fold portion 41*b*, by simply inserting the fold portion 41*b* to the inside of the through hole 75. Therefore, it is possible to make the task of attaching the holder 70 to the heat exchanger main body 40 easier.

Although various embodiments of the present disclosure are described above, the present disclosure is not limited to configurations of each of the embodiments thereof, and it is possible to adopt the configurations and/or methods mentioned below.

So long as a number of partition walls is greater than one, a number thereof is not limited. So long as a second direction in which a partition wall that partitions an inside of a peripheral wall is a direction that intersects a horizontal direction, the direction thereof is not particularly limited. The second direction may be a vertical direction. So long as a number of first partition walls is greater than or equal to one, the number thereof is not particularly limited. All of the partition walls may be the first partition wall.

One through portion, or three or more through portions may be formed on the first partition wall. When a plurality of first partition walls are provided, the plurality of first partition walls may include two or more first partition walls mutually having a different number of through portions formed thereon. It is possible that the through portion formed on the first partition wall only be one of either a first through portion, or a second through portion. Even in such case, it is possible to suitably and easily remove condensation water from an inside of an accommodation, and to suppress the condensation water from accumulating on an inside of the accommodation, using said through portions. When providing the plurality of first partition walls, the plurality of first partition walls may include the first partition walls that only have the first through portion formed thereon, and the plurality of first partition walls that only have the second portion formed thereon. A plurality of first through portions may be formed on one first partition wall. A plurality of second through portions may be formed on one first partition wall. Out of the through portions formed on the first partition wall, other through portions that differ from the first through portion and the second through portion may be included. A shape of the through portion that is formed on the first partition wall is not particularly limited to any shape.

A fold portion that is inserted through the through hole, and is housed on the inside of the accommodation need only have a portion thereof housed on the inside of the accommodation, with a portion thereof located on an outside of the accommodation. The holder need not contact a fin. For example, in the previously mentioned present embodiment, the base 71 may face the fin 42*c* located on the left most side (−Y side) out of the plurality of fins 42, via a gap.

A mating portion of the holder may have any shape. A number of mating portions is not particularly limited. The holder may not have a mating portion. The holder may be fixed to a heat exchanger main body. A shape of the heat exchanger main body is not limited to any particular shape. For example, in the previously mentioned present embodiment, the heat exchanger main body 40 need not have one of either of the first heat exchanger portion 40*a*, or the second heat exchanger portion 40*b*.

The heat exchanger main body may be formed of only one heat transfer pipe, or may be formed of a plurality of heat transfer pipes. When the heat exchanger main body is formed of a plurality of heat transfer pipes, one fold portion, or a plurality thereof may be provided in each heat transfer pipe.

The heat exchanger according to the present disclosure, in other words a heat exchange unit that includes a heat exchanger in which a through portion is formed on a first partition wall of the holder, may be an outdoor unit of an air conditioner. In the air conditioner according to the present disclosure, both an indoor unit and the outdoor unit may be heat exchange units that include heat exchangers as the heat exchanger according to the present disclosure. Or one of either of the indoor unit or the outdoor unit may be the heat exchange unit that includes the heat exchanger according to the present disclosure. The indoor unit which includes the heat exchanger according to the present disclosure may be any type of indoor unit, and may include a wall type indoor unit, or a floor type indoor unit.

The various configurations and various methods explained in the above specification may be combined as needed, so long as no conflicts in the technical scope thereof occurs.

REFERENCE SIGNS LIST

10 . . . Air Conditioner, 11 . . . Indoor Unit (Heat Exchange Unit), 12 . . . Outdoor Unit, 40 . . . Heat Exchanger Main Body, 41 . . . Heat Transfer Tube, 41*a* . . . Extension Portion, 41*b* . . . Fold Portion, 42, 42*c* . . . Fin, 50 . . . Blower, 70 . . . Holder, 71 . . . Base, 72 . . . Peripheral Wall, 73 . . . Partition Wall, 73*a* . . . First Partition, 73*b* . . . Second Partition, 73*c*, 73*d* . . . First Diagonal Wall, 73*e* . . . Second Diagonal Wall, 74 . . . Accommodation, 74*a* . . . Top Side Accommodation (Accommodation), 75 . . . Through Hole, 75*g* . . . Outside Hole, 76 . . . Mating Portion, 76*a* . . . Arm, 76*b* . . . Claw, 78 . . . First Through Hole, 79 . . . Second Through Hole, 90 . . . Heat Exchanger, D1 . . . First Diagonal Direction (Second Direction), D2 . . . Second Diagonal Direction (Second Direction), Y . . . Left-Right Direction (First Direction), Z . . . Vertical Direction

The invention claimed is:

1. A heat exchanger that is included in an air conditioner comprises:

a heat exchanger main body that extends in a first direction which intersects a vertical direction, and that has a heat transfer pipe and a plurality of fins which are attached to the heat transfer pipe, and a holder that is attached to one end of the first direction, on the heat exchanger main body, wherein the heat transfer pipe has a plurality of extension portions that extend in the first direction, and a plurality of fold portions that connect ends of pairs of the extension portions adjacent to one another in the first direction, the holder has a base located on one side of the first direction of the heat exchanger main body, a peripheral wall that protrudes to one side of the first direction, from an outside peripheral edge of the base, and at least one partition wall that partitions an inside of the peripheral wall in a second direction, that intersects a horizontal direction, a plurality of accommodations are formed so as to align in the second direction, using the base, the peripheral wall, and at least one partition wall, a through hole through which a fold portion out of the plurality of fold portions is inserted, is formed on each base on the plurality of accommodations, an inside edge of the through hole is disposed apart from the fold portion, said at least one partition wall includes a first partition wall, and at least one through portion that penetrates the first partition wall is formed on the first partition wall.

2. The heat exchanger according to claim 1, wherein said at least one through portion includes a first through portion that is formed on a portion that overlaps with the fin, out of the first partition wall, as seen in the first direction, and the first through portion is formed on an end of a side that is connected to the base out of the first partition wall, and is connected to the through hole.

3. The heat exchanger according to claim 2, wherein the first partition wall has a first diagonal wall, which extends in a direction that is located on the bottom side of the vertical direction, as the first through portion is approached.

4. The heat exchanger according to claim 1, wherein said at least one through portion includes a second through portion that is formed on a portion that is located an outside of the fin, out of the first partition wall, as seen in the first direction, the through hole includes an outside hole that is located on the outside of the fin as seen in the first direction, and the second through portion is formed apart from the outside hole in the first direction.

5. The heat exchanger according to claim 4, wherein the second through portion is formed on an end on an opposite side to the side that is connected to the base out of the first partition wall, and opens to one side in the first side.

6. The heat exchanger according to claim 4, wherein the first partition wall has a second diagonal wall, which extends in a direction located on the bottom side of the vertical direction, as the second through portion is approached.

7. The heat exchanger according to claim 1, wherein the partition wall is provided in plurality in the second direction, with intervals therebetween, the first partition wall, is provided in plurality in the second direction, with intervals therebetween, the plurality of partition walls include a second partition wall that is located on a bottom side of the vertical direction, more than the plurality of first partition walls, and the through portion is only formed on the first partition wall, out of the plurality of partition walls.

8. The heat exchanger according to claim 1, wherein the holder has a mating portion that is connected to the inside edge of the through hole, and the mating portion has an arm that extends from the inside edge of the through hole, and is elastically deformable, and a claw that connects to a tip of the arm, and hooks onto the fold portion from the other side of the first direction.

9. A heat exchange unit further comprises the heat exchanger according to claim 1, and a blower that blows air to the heat exchanger.

10. An air conditioner comprising an indoor unit, and an outdoor unit, wherein at least one of the indoor unit or the outdoor unit is the heat exchange unit according to claim 9.

* * * * *